US011810687B2

(12) United States Patent
Kusakari et al.

(10) Patent No.: US 11,810,687 B2
(45) Date of Patent: Nov. 7, 2023

(54) ALUMINUM ALLOY WIRE, ALUMINUM ALLOY STRAND WIRE, COVERED ELECTRICAL WIRE, AND TERMINAL-EQUIPPED ELECTRICAL WIRE

(71) Applicants: Sumitomo Electric Industries, Ltd., Osaka (JP); AutoNetworks Technologies, Ltd., Yokkaichi (JP); Sumitomo Wiring Systems, Ltd., Yokkaichi (JP)

(72) Inventors: Misato Kusakari, Osaka (JP); Tetsuya Kuwabara, Osaka (JP); Yoshihiro Nakai, Osaka (JP); Taichiro Nishikawa, Osaka (JP); Yasuyuki Otsuka, Yokkaichi (JP); Hayato Ooi, Yokkaichi (JP)

(73) Assignees: SUMITOMO ELECTRIC INDUSTRIES, LTD., Osaka (JP); AUTONETWORKS TECHNOLOGIES, LTD., Yokkaichi (JP); SUMITOMO WIRING SYSTEMS, LTD., Yokkaichi (JP)

( * ) Notice: Subject to any disclaimer, the term of this patent is extended or adjusted under 35 U.S.C. 154(b) by 162 days.

(21) Appl. No.: 17/317,180

(22) Filed: May 11, 2021

(65) Prior Publication Data

US 2021/0272717 A1 Sep. 2, 2021

Related U.S. Application Data

(63) Continuation of application No. 17/003,394, filed on Aug. 26, 2020, now Pat. No. 11,037,695, which is a (Continued)

(30) Foreign Application Priority Data

Oct. 31, 2016 (JP) ..... 2016-213155
Apr. 4, 2017 (JP) ..... 2017-074235

(51) Int. Cl.
*H01B 1/02* (2006.01)
*C22C 21/08* (2006.01)
(Continued)

(52) U.S. Cl.
CPC ..... *H01B 1/023* (2013.01); *C22C 21/00* (2013.01); *C22C 21/08* (2013.01); *C22F 1/05* (2013.01);
(Continued)

(58) Field of Classification Search
CPC ..... C22C 21/06; C22C 21/08; H01B 1/023; H01B 13/02–0292; B21C 3/04; C22F 1/05
See application file for complete search history.

(56) References Cited

U.S. PATENT DOCUMENTS

2010/0043520 A1* 2/2010 Sumiya ..... B21C 3/18 72/467
2010/0071933 A1* 3/2010 Otsuka ..... C22C 21/08 148/702
(Continued)

FOREIGN PATENT DOCUMENTS

CN 105206355 A * 12/2015
EP 2381001 A1 10/2011
(Continued)

OTHER PUBLICATIONS

Notice of Reasons for Refusal cited in JP Patent Application No. 2018-547161 dated Mar. 25, 2022.
(Continued)

*Primary Examiner* — Livius R. Cazan
(74) *Attorney, Agent, or Firm* — McCarter & English, LLP; Michael A. Sartori

(57) ABSTRACT

An aluminum alloy wire composed of an aluminum alloy, wherein the aluminum alloy contains more than or equal to
(Continued)

0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio, and the aluminum alloy wire has a dynamic friction coefficient of less than or equal to 0.8.

2 Claims, 3 Drawing Sheets

Related U.S. Application Data continuation of application No. 16/842,397, filed on Apr. 7, 2020, now Pat. No. 10,796,811, which is a continuation of application No. 16/677,734, filed on Nov. 8, 2019, now Pat. No. 10,650,936, which is a continuation of application No. 16/346,479, filed as application No. PCT/JP2017/030735 on Aug. 28, 2017, now Pat. No. 10,522,263.

(51) Int. Cl.

| | |
|---|---|
| ***C22F 1/05*** | (2006.01) |
| ***H01B 13/00*** | (2006.01) |
| ***H01B 5/08*** | (2006.01) |
| ***H01B 5/02*** | (2006.01) |
| ***C22C 21/00*** | (2006.01) |
| ***H01B 7/00*** | (2006.01) |
| *C22F 1/00* | (2006.01) |
| *C22F 1/04* | (2006.01) |

(52) U.S. Cl.

CPC ..... *H01B 1/02* (2013.01); *H01B 5/02* (2013.01); *H01B 5/08* (2013.01); *H01B 7/00* (2013.01); *H01B 13/0006* (2013.01); *H01B 13/0013* (2013.01); *C22F 1/00* (2013.01); *C22F 1/04* (2013.01)

(56) References Cited

U.S. PATENT DOCUMENTS

| | | | |
|---|---|---|---|
| 2012/0217060 | A1 | 8/2012 | Kusakari et al. |
| 2014/0047942 | A1 | 2/2014 | Tsuda et al. |

FOREIGN PATENT DOCUMENTS

| | | | | | |
|---|---|---|---|---|---|
| EP | 2383357 | A1 | | 11/2011 | |
| GB | 1509132 | A | * | 4/1978 | ..... B21B 3/003 |
| JP | 2003-303517 | A | | 10/2003 | |
| JP | 2012-229485 | A | | 11/2012 | |
| JP | 2013117052 | A | * | 6/2013 | |
| JP | 2015-5485 | A | | 1/2015 | |
| JP | 2015-124409 | A | | 7/2015 | |
| JP | 2015-166480 | A | | 9/2015 | |
| WO | 2010/082670 | A1 | | 7/2010 | |
| WO | 2010/082671 | A1 | | 7/2010 | |

OTHER PUBLICATIONS

"Organization of aluminum, property and Japan," Japan Institute of Light Metals, Nov. 30, 1991, pp. 376-396. [corresponds to NPL1].

* cited by examiner

| MANUFACTURING METHOD | WR | HEAT TREATMENT | STRIPPING | WIRE DRAWING | INTERMEDIATE HEAT TREATMENT | WIRE DRAWING | HEAT TREATMENT (CONTINUOUS) | AGING | SAMPLE No. |
|---|---|---|---|---|---|---|---|---|---|
| A | ✓ | – | – | ✓ | – | ✓ | ✓ | ✓ | 72 |
| B | ✓ | ✓ | – | ✓ | – | ✓ | – | ✓ | 73 |
| C | ✓ | ✓ | – | ✓ | – | ✓ | ✓ | ✓ | OTHER |
| D | ✓ | – | ✓ | ✓ | ✓ | ✓ | ✓ | ✓ | 74 |
| E | ✓ | ✓ | ✓ | ✓ | ✓ | ✓ | ✓ | ✓ | 75 |
| F | ✓ | – | – | ✓ | – | ✓ | – | ✓ | 76 |
| G | ✓ | ✓ | – | ✓ | – | ✓ | – | ✓ | 77 |

ALUMINUM ALLOY WIRE, ALUMINUM ALLOY STRAND WIRE, COVERED ELECTRICAL WIRE, AND TERMINAL-EQUIPPED ELECTRICAL WIRE

TECHNICAL FIELD

The present invention relates to an aluminum alloy wire, an aluminum alloy strand wire, a covered electrical wire, and a terminal-equipped electrical wire.

The present application claims a priority based on Japanese Patent Application No. 2016-213155 filed on Oct. 31, 2016 and claims a priority based on Japanese Patent Application No. 2017-074235 filed on Apr. 4, 2017, the entire contents of which are incorporated herein by reference.

BACKGROUND ART

As a wire member suitable for a conductor for electrical wires, PTL 1 discloses an aluminum alloy wire, which is a very thin wire composed of an Al—Mg—Si-based alloy and has a high strength, a high electrical conductivity and an excellent elongation.

CITATION LIST

Patent Literature

PTL 1: Japanese Patent Laying-Open No. 2012-229485

SUMMARY OF INVENTION

An aluminum alloy wire of the present disclosure is an aluminum alloy wire composed of an aluminum alloy, wherein the aluminum alloy contains more than or equal to 0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio, and the aluminum alloy wire has a dynamic friction coefficient of less than or equal to 0.8.

An aluminum alloy strand wire of the present disclosure includes a plurality of the above-described aluminum alloy wires of the present disclosure, the plurality of the aluminum alloy wires being stranded together.

A covered electrical wire of the present disclosure is a covered electrical wire including: a conductor; and an insulation cover that covers an outer circumference of the conductor, wherein the conductor includes the above-described aluminum alloy strand wire of the present disclosure.

A terminal-equipped electrical wire of the present disclosure includes: the above-described covered electrical wire of the present disclosure; and a terminal portion attached to an end portion of the covered electrical wire.

BRIEF DESCRIPTION OF DRAWINGS

FIG. 3 is an explanatory drawing illustrating a method of measuring voids or the like.

FIG. 4 is another explanatory drawing illustrating a method of measuring voids or the like.

DETAILED DESCRIPTION

Figure 1:
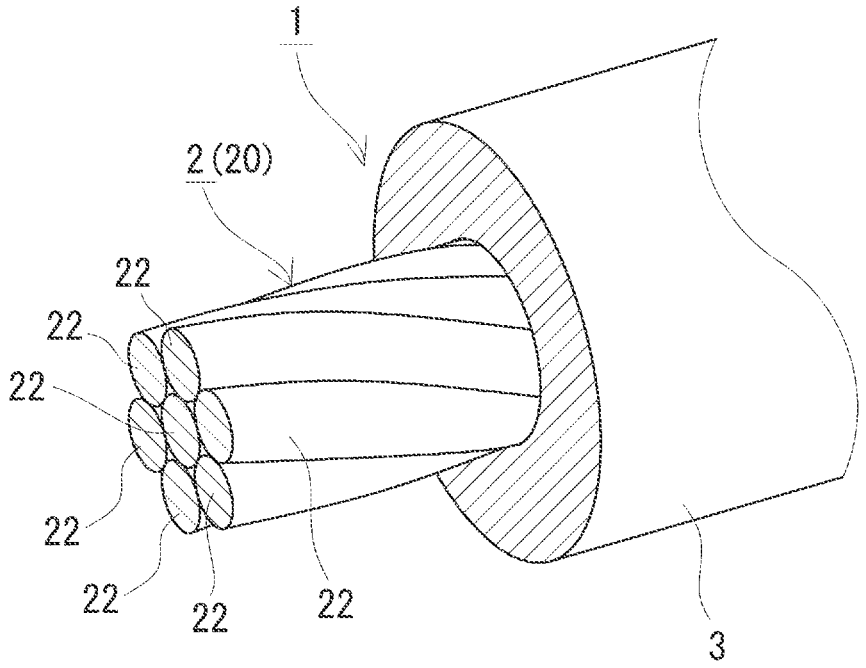
FIG. 1 is a schematic perspective view showing a covered electrical wire including an aluminum alloy wire in a conductor according to an embodiment.

Problems to be Solved by the Present Disclosure

As a wire member utilized for a conductor or the like included in an electrical wire, an aluminum alloy wire excellent in impact resistance and fatigue characteristic has been required.

Wire harnesses provided in devices of vehicles, airplanes or the like, wires for various types of electric devices such as industrial robots, and electrical wires for various purposes such as wires in buildings may be fed with an impact, repeated bending, or the like during device utilization, installation, and the like. Specifically, the following cases (1) to (3) can be considered.

(1) In the case of an electrical wire provided in a wire harness for vehicles, it is considered that: an impact is applied to a vicinity of a terminal portion when attaching the electrical wire to a target (PTL 1); a sudden impact is applied thereto in response to a traveling state of the vehicle; and repeated bending is applied thereto due to vibrations during traveling of the vehicle.

(2) In the case of an electrical wire provided in an industrial robot, it is considered that repeated bending, twisting, and the like are applied thereto.

(3) In the case of an electrical wire provided in a building, it is considered that: an impact is applied thereto by an operator pulling suddenly the electrical wire strongly or accidentally dropping the electrical wire during installation thereof; and repeated bending is applied by shaking and waving a wire member wound in the shape of a coil in order to eliminate curl of the wire member.

Therefore, an aluminum alloy wire utilized for a conductor or the like included in an electrical wire is required to be less likely to be disconnected when fed with not only an impact but also repeated bending.

In view of this, it is one object to provide an aluminum alloy wire excellent in impact resistance and fatigue characteristic. Moreover, it is another object to provide an aluminum alloy strand wire, a covered electrical wire, and a terminal-equipped electrical wire, each of which is excellent in impact resistance and fatigue characteristic.

Advantageous Effect of the Present Disclosure

The aluminum alloy wire of the present disclosure, the aluminum alloy strand wire of the present disclosure, the covered electrical wire of the present disclosure, and the terminal-equipped electrical wire of the present disclosure are excellent in impact resistance and fatigue characteristic.

DESCRIPTION OF EMBODIMENTS

The present inventors have manufactured aluminum alloy wires under various conditions and have examined aluminum alloy wires excellent in impact resistance and fatigue characteristic (resistance to disconnection in response to repeated bending). A wire member that is composed of an aluminum alloy having a specific composition including Mg and Si in specific ranges and that has been particularly through an aging treatment has a high strength (for example, a high tensile strength and a high 0.2% proof stress), a high electrical conductivity and an excellent electrical conductive property. Moreover, the present inventors have obtained the following knowledge: when this wire member is likely to slide, the wire member is less likely to be disconnected by repeated bending. The following knowledge has been obtained: such an aluminum alloy wire can be manufactured by, for example, providing a smooth surface of the wire member or adjusting an amount of lubricant on a surface of the wire member. The invention of the present application is based on such knowledge. First, embodiments of the invention of the present application are listed and described.

(1) An aluminum alloy wire according to one embodiment of the invention of the present application is an aluminum alloy wire composed of an aluminum alloy, wherein the aluminum alloy contains more than or equal to 0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio, and the aluminum alloy wire has a dynamic friction coefficient of less than or equal to 0.8.

The above-described aluminum alloy wire (hereinafter, also referred to as "Al alloy wire") is composed of the aluminum alloy (hereinafter, also referred to as "Al alloy") having the specific composition. The aluminum alloy wire has a high strength, is less likely to be disconnected even in response to application of repeated bending, and is excellent in fatigue characteristic because an aging treatment or the like is performed thereto during a manufacturing process. When the breaking elongation is high and the toughness is high, the impact resistance is also excellent. Particularly, since the above-described Al alloy wire has such a small dynamic friction coefficient, for example, in the case where a strand wire is formed using such Al alloy wires, the elemental wires are likely to slide on one another and are likely to be smoothly moved when bending or the like is applied, whereby the elemental wires are less likely to be disconnected to result in an excellent fatigue characteristic. Therefore, the above-described Al alloy wire is excellent in impact resistance and fatigue characteristic.

(2) As one exemplary embodiment of the above-described Al alloy wire, the aluminum alloy wire has a surface roughness of less than or equal to 3 μm.

In the above-described embodiment, the surface roughness is small and the dynamic friction coefficient is therefore likely to be small, thus particularly resulting in a more excellent fatigue characteristic.

(3) As one exemplary embodiment of the above-described Al alloy wire, a lubricant is adhered to a surface of the aluminum alloy wire, and an amount of adhesion of C originated from the lubricant is more than 0 mass % and less than or equal to 30 mass %.

In the above-described embodiment, it is considered that the lubricant adhered to the surface of the Al alloy wire is a remaining lubricant used in wire drawing or stranding during the manufacturing process. Since such a lubricant representatively includes carbon (C), an amount of adhesion of the lubricant is expressed by the amount of adhesion of C. In the above-described embodiment, due to the lubricant on the surface of the Al alloy wire, the dynamic friction coefficient is expected to be reduced, thus resulting in a more excellent fatigue characteristic. Moreover, in the above-described embodiment, a corrosion resistance is excellent due to the lubricant. Moreover, in the above-described embodiment, since the amount of the lubricant (amount of C) on the surface of the Al alloy wire falls within the specific range, the amount of the lubricant (amount of C) is small between the Al alloy wire and a terminal portion when the terminal portion is attached, whereby a connection resistance can be prevented from being increased due to an excessive amount of the lubricant therebetween. Therefore, the above-described embodiment can be utilized suitably for a conductor to which a terminal portion is attached, such as a terminal-equipped electrical wire. In this case, a connection structure having a particularly excellent fatigue characteristic, a low resistance and an excellent corrosion resistance can be constructed.

(4) As one exemplary embodiment of the above-described Al alloy wire, in a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is less than or equal to 2 $\mu m^2$.

The transverse section of the aluminum alloy wire refers to a cross section taken along a plane orthogonal to the axial direction (longitudinal direction) of the aluminum alloy wire.

In the above-described embodiment, a small amount of voids exist in the surface layer. Accordingly, even when an impact or repeated bending is applied, the voids are less likely to be origins of cracking, whereby cracking resulting from the voids is less likely to occur. Since surface cracking is less likely to occur, progress of cracking from the surface to the inner portion of the wire member and breakage of the wire member can be reduced, thus resulting in more excellent fatigue characteristic and impact resistance. Moreover, since the cracking resulting from the voids is less likely to occur in the above-described Al alloy wire, at least one of a tensile strength, a 0.2% proof stress, and a breaking elongation in a tensile test tends to be high although depending on a composition, a heat treatment condition, and the like, thus also resulting in an excellent mechanical characteristic.

(5) As one exemplary embodiment of the Al alloy wire according to (4) in which the content of the voids falls within the specific range, in the transverse section of the aluminum alloy wire, an inner void measurement region in a shape of a rectangle having a short side length of 30 μm and a long side length of 50 μm is defined such that a center of the rectangle of the inner void measurement region coincides with a center of the aluminum alloy wire, and a ratio of a total cross-sectional area of voids in the inner void measurement region to the total cross-sectional area of the voids in the surface-layer void measurement region is more than or equal to 1.1 and less than or equal to 44.

In the above-described embodiment, the ratio of the total cross-sectional area is more than or equal to 1.1. Hence, although the amount of voids in the inner portion of the Al alloy wire is larger than the amount of voids in the surface layer of the Al alloy wire, it can be said that the amount of voids in the inner portion of the Al alloy wire is also small because the ratio of the total cross-sectional area falls within the specific range. Therefore, in the above-described embodiment, even when an impact or repeated bending is applied, cracking is less likely to progress from the surface of the wire member to the inner portion of the wire member via the voids, and breakage is less likely to occur, thus resulting in more excellent impact resistance and fatigue characteristic.

(6) As one exemplary embodiment of the Al alloy wire according to (4) or (5) in which the content of the voids falls within the specific range, a content of hydrogen in the aluminum alloy wire is less than or equal to 8.0 ml/100 g.

The present inventors have checked gas constituents contained in the Al alloy wire containing the voids, and has obtained such knowledge that hydrogen is included in the Al alloy wire. Therefore, it is considered that one factor for the voids in the Al alloy wire is the hydrogen. In the above-described embodiment, since the content of hydrogen is small, it can be said that the amount of the voids is small. Hence, disconnection due to the voids is less likely to occur, thus resulting in excellent impact resistance and fatigue characteristic.

(7) As one exemplary embodiment of the above-described Al alloy wire, in a transverse section of the aluminum alloy wire, a surface-layer crystallization measurement region in a shape of a rectangle having a short side length of 50 μm and a long side length of 75 μm is defined within a surface layer region extending from a surface of the aluminum alloy wire by 50 μm in a depth direction, and an average area of crystallized materials in the surface-layer crystallization measurement region is more than or equal to 0.05 $\mu m^2$ and less than or equal to 3 $\mu m^2$.

The term "crystallized material", which representatively refers to a compound or simple element including at least one of Mg and Si, which are added elements, is assumed herein as a piece of the compound or simple element having an area of more than or equal to 0.05 $\mu m^2$ in the transverse section of the Al alloy wire (a piece of the compound or simple element having an equivalent circle diameter of more than or equal to 0.25 μm corresponding to the same area). A finer piece of the above-described compound having an area of less than 0.05 $\mu m^2$, representatively, having an equivalent circle diameter of less than or equal to 0.2 μm or less than or equal to 0.15 μm is referred to as a precipitated material.

In the above-described embodiment, the crystallized material in the surface layer of the Al alloy wire is fine and is less likely to be an origin of cracking, thus resulting in more excellent impact resistance and fatigue characteristic. Moreover, in the above-described embodiment, the fine crystallized material with the certain size may contribute to suppression of grain growth of the Al alloy or the like. With the fine crystal grains, the impact resistance and fatigue characteristic are expected to be improved.

(8) As one exemplary embodiment of the Al alloy wire according to (7) in which the sizes of the crystallized materials fall within the specific range, the number of the crystallized materials in the surface-layer crystallization measurement region is more than 10 and less than or equal to 400.

In the above-described embodiment, since the number of the fine crystallized materials in the surface layer of the Al alloy wire falls within the above-described specific range, each of the crystallized materials is less likely to be an origin of cracking and progress of cracking resulting from the crystallized material is likely to be reduced, thus resulting in excellent impact resistance and fatigue characteristic.

(9) As one exemplary embodiment of the Al alloy wire according to (7) or (8) in which the sizes of the crystallized materials fall within the specific range, in the transverse section of the aluminum alloy wire, an inner crystallization measurement region in a shape of a rectangle having a short side length of 50 μm and a long side length of 75 μm is defined such that a center of the rectangle of the inner crystallization measurement region coincides with a center of the aluminum alloy wire, and an average area of crystallized materials in the inner crystallization measurement region is more than or equal to 0.05 $\mu m^2$ and less than or equal to 40 $\mu m^2$.

In the above-described embodiment, each of the crystallized materials in the Al alloy wire is also fine. Hence, breakage resulting from the crystallized materials is more likely to be reduced, thus resulting in excellent impact resistance and fatigue characteristic.

(10) As one exemplary embodiment of the above-described Al alloy wire, an average crystal grain size of the aluminum alloy is less than or equal to 50 μm.

In the above-described embodiment, the crystal grains are fine and excellent in pliability, thus resulting in excellent impact resistance and fatigue characteristic.

(11) As one exemplary embodiment of the above-described Al alloy wire, a work hardening exponent of the aluminum alloy wire is more than or equal to 0.05.

In the above-described embodiment, since the work hardening exponent falls within the specific range, fixing force for a terminal portion can be expected to be improved by work hardening when the terminal portion is attached by way of crimping or the like. Therefore, the above-described embodiment can be utilized suitably for a conductor to which a terminal portion is attached, such as a terminal-equipped electrical wire.

(12) As one exemplary embodiment of the above-described Al alloy wire, a thickness of a surface oxide film of the aluminum alloy wire is more than or equal to 1 nm and less than or equal to 120 nm.

In the above-described embodiment, since the thickness of the surface oxide film falls within the specific range, an amount of oxide (constituting the surface oxide film) is small between the aluminum alloy wire and a terminal portion when the terminal portion is attached, whereby a connection resistance can be prevented from being increased due to an excessive amount of oxide therebetween and a corrosion resistance is also excellent. Therefore, the above-described embodiment can be utilized suitably for a conductor to which a terminal portion is attached, such as a terminal-equipped electrical wire. In this case, a connection structure having an excellent impact resistance, an excellent fatigue characteristic, a low resistance, and an excellent corrosion resistance can be constructed.

(13) As one exemplary embodiment of the above-described Al alloy wire, a tensile strength is more than or equal to 150 MPa, a 0.2% proof stress is more than or equal to 90 MPa, a breaking elongation is more than or equal to 5%, and an electrical conductivity is more than or equal to 40% IACS in the aluminum alloy wire.

In the above-described embodiment, each of the tensile strength, the 0.2% proof stress, and the breaking elongation is high. The mechanical characteristic is excellent and the impact resistance and the fatigue characteristic are excellent. Moreover, the electrical conductivity is high. The electrical characteristic is also excellent. Since the 0.2% proof stress is high, the above-described embodiment is excellent in terms of the fixation characteristic to the terminal portion.

(14) An aluminum alloy strand wire according to one embodiment of the invention of the present application includes a plurality of the aluminum alloy wires recited in any one of (1) to (13), the plurality of the aluminum alloy wires being stranded together.

Each elemental wire included in the above-described aluminum alloy strand wire (hereinafter, also referred to as "Al alloy strand wire") is composed of the Al alloy having the specific composition as described above. Moreover, generally, a strand wire has a more excellent flexibility than that of a solid wire having the same conductor cross-sectional area as that of the strand wire, and each elemental wire therein is less likely to be broken even under application of an impact, repeated bending, or the like. Furthermore, since the dynamic friction coefficient of each elemental wire is small, the elemental wires are likely to slide on one another in response to application of an impact, repeated bending or the like, whereby disconnection is less likely to occur due to friction between the elemental wires. In view of these, the above-described Al alloy strand wire is excellent in impact resistance and fatigue characteristic. Since each elemental wire is excellent in the mechanical characteristic as described above, at least one of the tensile strength, the 0.2% proof stress, and the breaking elongation tends to be high in the above-described Al alloy strand wire, thus resulting in an excellent mechanical characteristic.

(15) As one exemplary embodiment of the above-described Al alloy strand wire, a strand pitch is more than or equal to 10 times and less than or equal to 40 times as large as a pitch diameter of the aluminum alloy strand wire.

The term "pitch diameter" refers to the diameter of a circle that connects the respective centers of all the elemental wires included in each layer when the strand wire has a multilayer structure.

In the above-described embodiment, since the strand pitch falls within the specific range, the elemental wires are less likely to be twisted under application of bending or the like and therefore are less likely to be broken. Moreover, when a terminal portion is attached, the elemental wires are less likely to be unbound. Accordingly, the terminal portion is facilitated to be attached. Therefore, in the above-described embodiment, the fatigue characteristic is particularly excellent, and the above-described embodiment can be utilized suitably for a conductor to which a terminal portion is attached, such as a terminal-equipped electrical wire.

(16) A covered electrical wire according to one embodiment of the invention of the present application is a covered electrical wire including: a conductor; and an insulation cover that covers an outer circumference of the conductor, wherein the conductor includes the aluminum alloy strand wire recited in (14) or (15).

The above-described covered electrical wire includes the conductor constituted of the above-described Al alloy strand wire excellent in impact resistance and fatigue characteristic, and is therefore excellent in impact resistance and fatigue characteristic.

(17) A terminal-equipped electrical wire according to one embodiment of the invention of the present application includes: the covered electrical wire recited in (16); and a terminal portion attached to an end portion of the covered electrical wire.

The above-described terminal-equipped electrical wire includes, as a component, the covered electrical wire including the conductor constituted of the Al alloy wire or Al alloy strand wire excellent in impact resistance and fatigue characteristic, and is therefore excellent in impact resistance and fatigue characteristic.

Details of Embodiments of the Invention of the Present Application

The following describes the embodiments of the present invention in detail with reference to figures as required. In the figures, the same reference characters designate the same components. In the description below, the content of an element is expressed in mass %.

[Aluminum Alloy Wire]

(Overview)

An aluminum alloy wire (Al alloy wire) 22 of an embodiment is a wire member composed of an aluminum alloy (Al alloy), and is representatively utilized for a conductor 2 of an electrical wire or the like (FIG. 1). In this case, Al alloy wire 22 is used in the following state: a solid wire; a strand wire including a plurality of Al alloy wires 22 stranded together (Al alloy strand wire 20 of the embodiment); or a compressed strand wire in which the strand wire is compressed into a predetermined shape (another example of Al alloy strand wire 20 of the embodiment). FIG. 1 illustrates Al alloy strand wire 20 including seven Al alloy wires 22 stranded together. In Al alloy wire 22 of the embodiment, the Al alloy has such a specific composition that Mg and Si are included in respective specific ranges, and Al alloy wire 22 has a small dynamic friction coefficient. Specifically, the Al alloy of Al alloy wire 22 of the embodiment is an Al—Mg—Si-based alloy containing more than or equal to 0.03% and less than or equal to 1.5% of Mg, more than or equal to 0.02% and less than or equal to 2.0% of Si, and a remainder of Al and an inevitable impurity, Mg/Si being more than or equal to 0.5 and less than or equal to 3.5 in mass ratio. Moreover, the dynamic friction coefficient of Al alloy wire 22 of the embodiment is less than or equal to 0.8. When Al alloy wire 22 of the embodiment, which has the above-described specific composition and has such a specific surface property, is subjected to an aging treatment or the like during a manufacturing process, Al alloy wire 22 of the embodiment has a high strength and is less likely to be broken due to friction, thus resulting in excellent impact resistance and fatigue characteristic.

Hereinafter, more detailed explanation will be described. It should be noted that details of a method of measuring each parameter such as the dynamic friction coefficient as well as details of the above-described effects will be described in Test Example.

(Composition)

Al alloy wire 22 of the embodiment is composed of the Al—Mg—Si-based alloy. In Al alloy wire 22, Mg and Si are dissolved in a solid state and exist as crystallized materials and precipitated materials, thus resulting in an excellent strength. Since Mg, which is an element allowing for a high strength improvement effect, and Si are contained together in the specific ranges, specifically, more than or equal to 0.03% of Mg and more than or equal to 0.02% of Si are contained, the strength can be improved effectively by age hardening. Since the strength of the Al alloy wire is increased as the contents of Mg and Si are higher and less than or equal to 1.5% of Mg and less than or equal to 2.0% of Si are included, decreases in electrical conductivity and toughness due to the contained Mg and Si are less likely to occur, a high electrical conductivity, a high toughness, and the like are attained, disconnection is less likely to occur during wire drawing, and manufacturability is also excellent. In consideration of a balance among the strength, the toughness, and the electrical conductivity, the content of Mg can be more than or equal to 0.1% and less than or equal to 2.0%, more than or equal to 0.2% and less than or equal to 1.5%, or more than or equal to 0.3% and less than or equal to 0.9%, and the content of Si is more than or equal to 0.1% and less than or equal to 2.0%, more than or equal to 0.1% and less than or equal to 1.5%, or more than or equal to 0.3% and less than or equal to 0.8%.

By setting the contents of Mg and Si to fall within the above-described specific ranges and setting the mass ratio of Mg and Si to fall within the specific range, Mg and Si can exist appropriately in the state of crystallized materials or precipitated materials while avoiding one of Mg and Si from being excessive, thus favorably resulting in excellent strength and electrical conductive property. Specifically, the ratio (Mg/Si) of the mass of Mg to the mass of Si is preferably more than or equal to 0.5 and less than or equal to 3.5, and is more preferably more than or equal to 0.8 and less than or equal to 3.5 or more than or equal to 0.8 and less than or equal to 2.7.

In addition to Mg and Si, the Al alloy of Al alloy wire 22 of the embodiment can contain one or more elements selected from Fe, Cu, Mn, Ni, Zr, Cr, Zn, and Ga (hereinafter also collectively referred to as "element a"). Fe and Cu cause a small decrease in the electrical conductivity and can provide an improved strength. Mn, Ni, Zr, and Cr cause a large decrease in the electrical conductivity but provide a high strength improvement effect. Zn causes a small decrease in the electrical conductivity and has a certain degree of the strength improvement effect. Ga has a strength improvement effect. Due to the improvement in strength, the fatigue characteristic is excellent. Moreover, Fe, Cu, Mn, Zr, and Cr have a fine crystal attaining effect. With a fine crystalline structure, toughness such as breaking elongation becomes excellent and pliability becomes excellent, thus facilitating bending or the like. Hence, the impact resistance and the fatigue characteristic can be expected to be improved. The content of each of the above-listed elements is more than or equal to 0% and less than or equal to 0.5%, and the total content of the above-listed elements is more than or equal to 0% and less than or equal to 1.0%. Particularly, when the content of each element is more than or equal to 0.01% and less than or equal to 0.5% and the total content of the above-listed elements is more than or equal to 0.01% and less than or equal to 1.0%, the above-described strength improvement effect as well as an impact resistance improvement effect, a fatigue characteristic improvement effect, and the like are likely to be obtained. The content of each of the elements is, for example, as described below. In the above-described range of the total content and the range of the below-described content of each element, the improvement in strength tend to be facilitated as the total content of the elements and the content of each of the elements are larger, and the increase in electrical conductivity tends to be facilitated as the total content of the elements and the content of each of the elements are smaller.

(Fe) more than or equal to 0.01% and less than or equal to 0.25%, or more than or equal to 0.01% and less than or equal to 0.2%

(Each of Cu, Mn, Ni, Zr, Cr, and Zn) more than or equal to 0.01% and less than or equal to 0.5%, or more than or equal to 0.01% and less than or equal to 0.3%

(Ga) more than or equal to 0.005% and less than or equal to 0.1%, or more than or equal to 0.005% and less than or equal to 0.05%

It should be noted that when a component analysis is performed onto pure aluminum used as a source material and the source material includes the added elements such as Mg, Si and element a as impurities, an amount of addition of each element may be adjusted to attain desired contents of these elements. Namely, the content of each of the added elements is a total amount inclusive of the corresponding element included in the aluminum ingot used as the source material, and does not necessarily means the amount of addition of the corresponding element.

In addition to Mg and Si, the Al alloy included in Al alloy wire 22 of the embodiment can contain at least one of Ti and B. Each of Ti and B has an effect of attaining a fine crystal in the Al alloy during casting. By using a cast material having a fine crystalline structure for a base material, crystal grains are likely to be fine even when it is subjected to a process such as rolling or wire drawing or a heat treatment including an aging treatment, after the casting. Al alloy wire 22 having the fine crystalline structure is less likely to be broken in response to application of an impact or repeated bending as compared with a case where Al alloy wire 22 has a coarse crystalline structure. Therefore, Al alloy wire 22 is excellent in impact resistance and fatigue characteristic. The fine crystal attaining effect tends to be higher in the order of a case where B is solely contained, a case where Ti is solely contained, and a case where both Ti and B are contained. When Ti is contained and the content of Ti is more than or equal to 0% and less than or equal to 0.05% or more than or equal to 0.005% and less than or equal to 0.05% and/or when B is contained and the content of B is more than or equal to 0% and less than or equal to 0.005% or more than or equal to 0.001% and less than or equal to 0.005%, the fine crystal attaining effect is obtained and a decrease in the electrical conductivity due to the contained Ti and/or B can be reduced. In consideration of a balance between the fine crystal attaining effect and the electrical conductivity, the content of Ti can be set to more than or equal to 0.01% and less than or equal to 0.04% or less than or equal to 0.03%, and the content of B can be set to more than or equal to 0.002% and less than or equal to 0.004%.

Specific examples of the composition containing the above-described element a and the like in addition to Mg and Si are described as follows. In the following specific examples, the mass ratio, Mg/Si, is preferably more than or equal to 0.5 and less than or equal to 3.5.

(1) A composition containing more than or equal to 0.03% and less than or equal to 1.5% of Mg, more than or equal to 0.02% and less than or equal to 2.0% of Si, more than or equal to 0.01% and less than or equal to 0.25% of Fe, and a remainder of Al and an inevitable impurity.

(2) A composition containing more than or equal to 0.03% and less than or equal to 1.5% of Mg, more than or equal to 0.02% and less than or equal to 2.0% of Si, more than or equal to 0.01% and less than or equal to 0.25% of Fe, more than or equal to 0.01% and less than or equal to 0.3% of one or more elements selected from Cu, Mn, Ni, Zr, Cr, Zn, and Ga in total, and a remainder of Al and an inevitable impurity.

(3) The composition (1) or (2) containing at least one of more than or equal to 0.005% and less than or equal to 0.05% of Ti and more than or equal to 0.001% and less than or equal to 0.005% of B.

(Surface Property)

Dynamic Friction Coefficient

The dynamic friction coefficient of Al alloy wire 22 of the embodiment is less than or equal to 0.8. For example, when Al alloy wire 22 having such a small dynamic friction coefficient is used for an elemental wire of a strand wire and repeated bending is applied to this strand wire, friction is small between the elemental wires (Al alloy wires 22) and the elemental wires are likely to slide on one another, with the result that each elemental wire can be moved smoothly. Here, if the dynamic friction coefficient is large, the friction between the elemental wires is large. Hence, when repeated bending is applied, each of the elemental wires is likely to be broken due to this friction, with the result that the strand wire is likely to be disconnected. Particularly when used for the strand wire, Al alloy wire 22 having a dynamic friction coefficient of less than or equal to 0.8 can reduce the friction between the elemental wires. Accordingly, each of the elemental wires is less likely to be broken even under application of repeated bending, thus resulting in an excellent fatigue characteristic. Even when an impact is applied thereto, the elemental wires slide on one another, whereby it is expected that the impact is reduced and each of the elemental wires is less likely to be broken. As the dynamic friction coefficient is smaller, breakage resulting from friction can be more reduced. The dynamic friction coefficient is preferably less than or equal to 0.7, less than or equal to 0.6, or less than or equal to 0.5. The dynamic friction coefficient is likely to be small by providing a smooth surface of Al alloy wire 22, applying a lubricant to the surface of Al alloy wire 22, or both.

Surface Roughness

As one example, Al alloy wire 22 of the embodiment has a surface roughness of less than or equal to 3 μm. In Al alloy wire 22 having such a small surface roughness, the dynamic friction coefficient tends to be small. When Al alloy wire 22 is used for an elemental wire of a strand wire as described above, friction between the elemental wires can be made small, thus resulting in an excellent fatigue characteristic. In some cases, the impact resistance can be also expected to be improved. As the surface roughness is smaller, the dynamic friction coefficient is likely to be smaller and the friction between the elemental wires is likely to be smaller. Hence, the surface roughness is preferably less than or equal to 2.5 μm, less than or equal to 2 μm, or less than or equal to 1.8 μm. For example, the surface roughness is likely to be small by manufacturing Al alloy wire 22 to have a smooth surface in the following manner: a wire drawing die having a surface roughness of less than or equal to 3 μm is used; a larger amount of lubricant is prepared upon wire drawing; or the like. When the lower limit of the surface roughness is set to 0.01 μm or 0.03 μm, it is expected to facilitate industrial mass-production of Al alloy wire 22.

C Amount

As one example, in Al alloy wire 22 of the embodiment, a lubricant is adhered to a surface of Al alloy wire 22 and an amount of adhesion of C originated from the lubricant is more than 0 mass % and less than or equal to 30 mass %. It is considered that the lubricant adhered to the surface of Al alloy wire 22 is a remaining lubricant (representatively, oil) used in the manufacturing process as described above. In Al alloy wire 22 having the amount of adhesion of C in the above-described range, the dynamic friction coefficient is likely to be small due to the adhesion of the lubricant. The dynamic friction coefficient tends to be smaller as the amount of adhesion of C is larger in the above-described range. Since the dynamic friction coefficient is small, friction between the elemental wires can be made small when Al alloy wire 22 is used for an elemental wire of a strand wire as described above, thus resulting in an excellent fatigue characteristic. In some cases, the impact resistance can be also expected to be improved. Moreover, the corrosion resistance is excellent due to the adhesion of the lubricant. As the amount of adhesion is smaller in the above-described range, an amount of the lubricant between conductor 2 and a terminal portion 4 (FIG. 2) can be reduced when terminal portion 4 is attached to an end portion of conductor 2 constituted of Al alloy wires 22. In this case, a connection resistance between conductor 2 and terminal portion 4 can be prevented from being increased due to an excessive amount of the lubricant therebetween. In consideration of the reduction of the friction and the suppression of increase of the connection resistance, the amount of adhesion of C can be set to more than or equal to 0.5 mass % and less than or equal to mass % or more than or equal to 1 mass % and less than or equal to 20 mass %. In order to attain a desired amount of adhesion of C, it is considered to adjust an amount of use of the lubricant during wire drawing or stranding or to adjust a heat treatment condition or the like, for example. This is because the lubricant is reduced or removed depending on a heat treatment condition.

Surface Oxide Film

As one example, the thickness of a surface oxide film of Al alloy wire 22 of the embodiment is more than or equal to 1 nm and less than or equal to 120 nm. When a heat treatment such as an aging treatment is performed, an oxide film can be formed in the surface of Al alloy wire 22. Since the thickness of the surface oxide film is so thin as to be less than or equal to 120 nm, an amount of oxide between conductor 2 and terminal portion 4 can be reduced when terminal portion 4 is attached to the end portion of conductor 2 constituted of Al alloy wires 22. Since the amount of oxide, which is an electrical insulator, between conductor 2 and terminal portion 4 is small, increase in the connection resistance between conductor 2 and terminal portion 4 can be reduced. On the other hand, when the surface oxide film is of more than or equal to 1 nm, the corrosion resistance of Al alloy wire 22 can be improved. As the surface oxide film is thinner in the above-described range, the increase of the connection resistance can be reduced. As the surface oxide film is thicker in the above-described range, the corrosion resistance can be more improved. In consideration of the suppression of increase of the connection resistance and the corrosion resistance, the thickness of the surface oxide film can be set to more than or equal to 2 nm and less than or equal to 115 nm, or more than or equal to 5 nm and less than or equal to 110 nm or less than or equal to 100 nm. The thickness of the surface oxide film can be adjusted and changed in accordance with a heat treatment condition, for example. Particularly, when an oxygen concentration in an atmosphere is high (for example, as in an atmospheric air), the surface oxide film is facilitated to be thick. When the oxygen concentration is low (for example, as in an inert gas atmosphere, a reducing gas atmosphere, or the like), the surface oxide film is facilitated to be thin.

(Structure)

Voids

Figure 3:
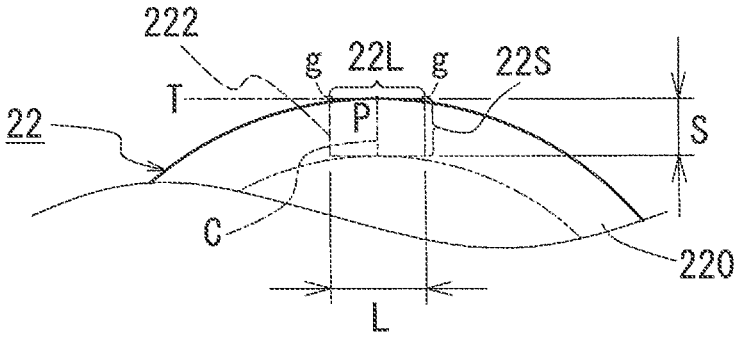

As one example, a small amount of voids exist in a surface layer of Al alloy wire 22 of the embodiment. Specifically, in a transverse section of Al alloy wire 22, as shown in FIG. 3, a surface layer region 220 extending from the surface of Al alloy wire 22 by 30 μm in a depth direction, i.e., an annular region having a thickness of 30 μm is defined. A surface-layer void measurement region 222 (indicated by a broken line in FIG. 3) in the shape of a rectangle having a short side length S of 30 μm and a long side length L of 50 μm is defined within this surface layer region 220. Short side length S corresponds to the thickness of surface layer region 220. Specifically, a tangent line T to an arbitrary point (contact point P) of the surface of Al alloy wire 22 is drawn. A straight line C having a length of 30 μm is drawn from contact point P toward the inner portion of Al alloy wire 22 in a direction normal to the surface. When Al alloy wire 22 is a round wire, straight line C is drawn toward the center of the circle of the round wire. A short side 22S is represented by a straight line parallel to straight line C and having a length of 30 μm. A long side 22L is represented by a straight line that passes through contact point P, that extends along tangent line T and that has a length of 50 μm with contact point P serving as an intermediate point. A minute void (hatching portion) g involving no Al alloy wire 22 is permitted to exist in surface-layer void measurement region 222. The total cross-sectional area of the voids in this surface-layer void measurement region 222 is less than or equal to 2 $\mu m^2$. Since the amount of voids is small in the surface layer, cracking from the voids is likely to be reduced under application of an impact or repeated bending. This leads to reduced progress of cracking from the surface layer to the inner portion. Accordingly, breakage due to the voids can be reduced. Accordingly, this Al alloy wire 22 is excellent in impact resistance and fatigue characteristic. On the other hand, if the total area of the voids is large, large voids or a multiplicity of fine voids exist.

Accordingly, cracking occurs from such voids and is facilitated to be progressed, thus resulting in inferior impact resistance and fatigue characteristic. Meanwhile, as the total cross-sectional area of the voids is smaller, the amount of the voids is smaller. Accordingly, breakage due to the voids is reduced, thus resulting in excellent impact resistance and fatigue characteristic. Hence, the total cross-sectional area of the voids is preferably less than or equal to 1.9 $\mu m^2$, less than or equal to 1.8 $\mu m^2$, or less than or equal to 1.2 $\mu m^2$. It is more preferable that the total cross-sectional area of the voids is closer to 0. For example, the voids are likely to be reduced when a temperature of melt is made low in the casting process. In addition, by increasing a cooling rate during casting, particularly, a cooling rate in a specific temperature range described later, smaller amount and smaller size of voids are likely to be attained.

Figure 4:
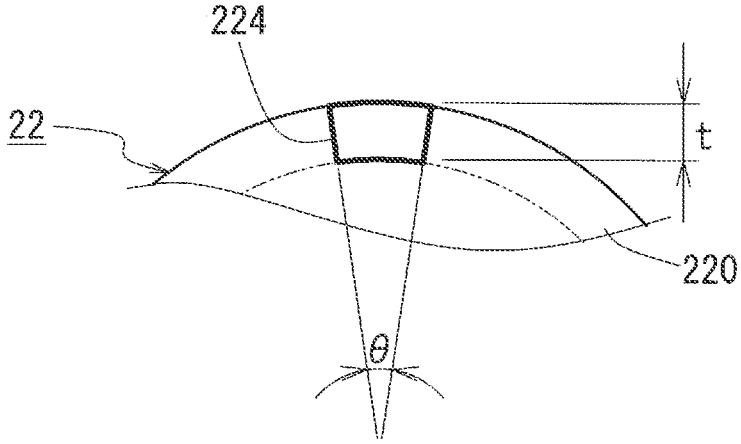

When Al alloy wire 22 is a round wire or when Al alloy wire 22 can be substantially regarded as a round wire, the void measurement region in the surface layer can be in the shape of a sector as shown in FIG. 4. In FIG. 4, measurement region 224 is represented by a thick line for the purpose of better understanding. As shown in FIG. 4, in the transverse section of Al alloy wire 22, a surface layer region 220 extending from the surface of Al alloy wire 22 by 30 μm in the depth direction, i.e., an annular region having a thickness t of 30 μm is defined. A region (referred to as "measurement region 224") in the shape of a sector having an area of 1500 $\mu m^2$ is defined within this surface layer region 220. By utilizing the area of annular surface layer region 220 and the area of 1500 $\mu m^2$ of void measurement region 224, a central angle θ of the region in the shape of a sector having an area of 1500 $\mu m^2$ is calculated, thereby extracting the void measurement region 224 in the shape of a sector from annular surface layer region 220. When the total cross-sectional area of the voids in this void measurement region 224 in the shape of a sector is less than or equal to 2 $\mu m^2$, Al alloy wire 22 excellent in impact resistance and fatigue characteristic can be obtained due to the reason described above. When both the surface-layer void measurement region in the shape of a rectangle and the void measurement region in the shape of a sector are defined and the total area of the voids in each of the regions is less than or equal to 2 $\mu m^2$, it is expected to improve reliability as a wire member excellent in impact resistance or fatigue characteristic.

As one example, Al alloy wire 22 of the embodiment include a small amount of voids not only in the surface layer but also in the inner portion of Al alloy wire 22. Specifically, in the transverse section of Al alloy wire 22, a region (referred to as "inner void measurement region") in the shape of a rectangle having a short side length of 30 μm and a long side length of 50 μm is defined. This inner void measurement region is defined such that the center of the rectangle of the inner void measurement region coincides with the center of Al alloy wire 22. When Al alloy wire 22 is a shaped wire, the center of an inscribed circle therein coincides with the center of Al alloy wire 22 (the same applies to the description below). In at least one of the surface-layer void measurement region in the shape of a rectangle and the void measurement region in the shape of a sector, a ratio (Sib/Sfb) of total cross-sectional area Sib of voids in the inner void measurement region to total cross-sectional area Sfb of the voids in the measurement region is more than or equal to 1.1 and less than or equal to 44. Here, in a casting process, generally, solidification progresses from a surface layer toward an inner portion of a metal. Accordingly, when a gas in an atmosphere is dissolved in the melt, the gas is likely to move out of the surface layer of the metal but the gas is likely to be confined and remain in the inner portion of the metal. When a wire member is manufactured using such a cast material as a base material, it is considered that an amount of voids in the inner portion of the metal is likely to be larger than that in the surface layer thereof. In the embodiment in which ratio Sib/Sfb is smaller as total cross-sectional area Sfb of the voids in the surface layer is smaller as described above, the amount of voids in the inner portion is also small. Therefore, according to this embodiment, when an impact or repeated bending is applied, occurrence of cracking, progress of cracking, and the like are likely to be reduced, whereby breakage resulting from voids is reduced. This results in excellent impact resistance and fatigue characteristic. Since as ratio Sib/Sfb is smaller, the amount of voids in the inner portion is smaller to result in excellent impact resistance and fatigue characteristic, ratio Sib/Sfb is more preferably less than or equal to 40, less than or equal to 30, less than or equal to 20, or less than or equal to 15. As long as ratio Sib/Sfb is more than or equal to 1.1, Al alloy wire 22 having a small amount of voids can be manufactured even when the temperature of melt is not made too low. This is considered to be suitable for mass production. It is considered that the mass production is facilitated when ratio Sib/Sfb is 1.3 to 6.0.

Crystallized Materials

As one example, Al alloy wire 22 of the embodiment has a certain amount of fine crystallized materials in the surface layer. Specifically, in the transverse section of Al alloy wire 22, a region (referred to as "surface-layer crystallization measurement region") in the shape of a rectangle having a short side length of 50 μm and a long side length of 75 μm is defined within a surface layer region extending from the surface of Al alloy wire 22 by 50 μm in the depth direction, i.e., within an annular region having a thickness of 50 μm. The short side length corresponds to the thickness of the surface layer region. The average area of the crystallized materials in this surface-layer crystallization measurement region is more than or equal to 0.05 $\mu m^2$ and less than or equal to 3 $\mu m^2$. When Al alloy wire 22 is a round wire or when Al alloy wire 22 can be substantially regarded as a round wire, in the transverse section of Al alloy wire 22, a region (referred to as "crystallization measurement region") in the shape of a sector having an area of 3750 $\mu m^2$ is defined within the above-described annular region having a thickness of 50 μm, and an average area of the crystallized materials in this crystallization measurement region in the shape of a sector is more than or equal to 0.05 $\mu m^2$ and less than or equal to 3 $\mu m^2$. The surface-layer crystallization measurement region in the shape of a rectangle or crystallization measurement region in the shape of a sector may be defined by changing short side length S to 50 μm, changing long side length L to 75 μm, changing thickness t to 50 μm, or changing the area to 3750 $\mu m^2$, in the same manner as in the above-described surface-layer void measurement region 222 and the void measurement region 224 in the shape of a sector. When both the surface-layer crystallization measurement region in the shape of a rectangle and the crystallization measurement region in the shape of a sector are defined and each of the average areas of the crystallized materials in these measurement regions is more than or equal to 0.05 $\mu m^2$ and less than or equal to 3 $\mu m^2$, it is expected to improve reliability as a wire member excellent in impact resistance and fatigue characteristic. Even though there are a plurality of crystallized materials in the surface layer, the average size of the crystallized materials is less than or equal to 3 $\mu m^2$. Hence, when an impact or repeated bending is applied, cracking from each crystallized material is likely to be reduced. This leads to reduction of progress of cracking from the surface layer to the inner portion, thus resulting in reduction of breakage resulting from the crystallized materials. Accordingly, this Al alloy wire 22 is excellent in impact resistance and fatigue characteristic. On the other hand, if the average area of the crystallized materials is large, coarse crystallized materials, each of which may serve as an origin of cracking, are likely to be included, thus resulting in inferior impact resistance and fatigue characteristic. Meanwhile, since the average size of the crystallized materials is more than or equal to 0.05 $\mu m^2$, the following effects can be expected: reduction of decrease in electrical conductivity due to the added elements, such as Mg and Si, dissolved in a solid state; and suppression of crystal grain growth. As the above-described average area is smaller, the cracking is more likely to be reduced. The average area is preferably less than or equal to 2.5 $\mu m^2$, less than or equal to 2 $\mu m^2$, or less than or equal to 1 $\mu m^2$. In order to obtain a certain amount of crystallized materials, the average area can be more than or equal to 0.08 $\mu m^2$ or more than or equal to 0.1 $\mu m^2$. The crystallized materials can be likely to become small by decreasing the added elements such as Mg and Si or increasing the cooling rate during the casting, for example.

In addition to the above-described specific sizes of the crystallized materials in the surface layer, the number of the crystallized materials is preferably more than 10 and less than or equal to 400 in at least one of the surface-layer crystallization measurement region in the shape of a rectangle and the crystallization measurement region in the shape of a sector. Since the number of the crystallized materials having the above-described specific sizes is not too large, i.e., less than or equal to 400, the crystallized materials are less likely to serve as origins of cracking and progress of cracking from the crystallized materials is likely to be reduced. Accordingly, this Al alloy wire 22 is more excellent in impact resistance and fatigue characteristic. As the number of the crystallized materials is smaller, occurrence of cracking is likely to be more reduced. In view of this, the number of the crystallized materials is preferably less than or equal to 350, less than or equal to 300, less than or equal to 250, or less than or equal to 200. When there are more than 10 crystallized materials having the above-described specific sizes, the following effects can be expected as described above: suppression of decrease in electrical conductivity; suppression of crystal grain growth; and the like. In view of this, the number of the crystallized materials can be more than or equal to 15 or more than or equal to 20.

Further, when many of the crystallized materials in the surface layer have sizes of less than or equal to 3 $\mu m^2$, the crystallized materials are less likely to serve as origins of cracking because they are fine, and dispersion strengthening provided by the crystallized materials having a uniform size can be expected. In view of this, in at least one of the surface-layer crystallization measurement region in the shape of a rectangle and the crystallization measurement region in the shape of a sector, the total area of the crystallized materials each having an area of less than or equal to 3 $\mu m^2$ in the measurement region is preferably more than or equal to 50% and is more preferably more than or equal to 60% or more than or equal to 70% with respect to the total area of all the crystallized materials in the measurement region.

As one example, in Al alloy wire 22 of the embodiment, there are a certain amount of fine crystallized materials not only in the surface layer of Al alloy wire 22 but also in the inner portion of Al alloy wire 22. Specifically, in the transverse section of Al alloy wire 22, a region (referred to as "inner crystallization measurement region") in the shape of a rectangle having a short side length of 50 μm and a long side length of 75 μm is defined. This inner crystallization measurement region is defined such that the center of the rectangle coincides with the center of Al alloy wire 22. The average area of the crystallized materials in the inner crystallization measurement region is more than or equal to 0.05 $\mu m^2$ and less than or equal to 40 $\mu m^2$. Here, the crystallized materials are formed by the casting process and may be divided due to plastic working after the casting; however, the sizes thereof in the cast material are likely to be substantially maintained also in the Al alloy wire 22 having the final wire diameter. In the casting process, solidification progresses from the surface layer of the metal toward the inner portion of the metal as described above. Hence, the temperature of the inner portion of the metal is likely to be maintained to be higher than the temperature of the surface layer of the metal for a long period of time. Accordingly, the crystallized materials in the inner portion of Al alloy wire 22 are likely to be larger than the crystallized materials in the surface layer. On the other hand, in Al alloy wire 22 of the above-described embodiment, the crystallized material in the inner portion is also fine. Hence, breakage resulting from the crystallized material is more likely to be reduced, thus resulting in excellent impact resistance and fatigue characteristic. As with the case of the above-described surface layer, in order to reduce breakage, it is more preferable that the average area is smaller such as less than or equal to 20 $\mu m^2$ or less than or equal to 10 $\mu m^2$, particularly, less than or equal to 5 $\mu m^2$ or less than or equal to 2.5 $\mu m^2$, whereas in order to obtain a certain amount of crystallized materials, the average area can be more than or equal to 0.08 $\mu m^2$ or more than or equal to 0.1 $\mu m^2$.

Crystal Grain Size

As one example, in Al alloy wire 22 of the embodiment, the average crystal grain size of the Al alloy is less than or equal to 50 μm. Al alloy wire 22 having a fine crystalline structure is readily bent, is excellent in pliability, and is less likely to be broken under application of an impact or repeated bending. Al alloy wire 22 of the embodiment, which also has a small dynamic friction coefficient, is excellent in impact resistance and fatigue characteristic. When the amount of voids in the surface layer is small as described above, and preferably, when the sizes of the crystallized materials are also small, Al alloy wire 22 is more excellent in impact resistance and fatigue characteristic. As the above-described average crystal grain size is smaller, bending or the like is more facilitated and the impact resistance and fatigue characteristic are more excellent. Hence, the average crystal grain size is preferably less than or equal to 45 μm, less than or equal to 40 μm, or less than or equal to 30 μm. Although depending on a composition or manufacturing condition, the crystal grain size is likely to be fine when Ti, B and an element having the fine crystal attaining effect in element a are included as described above, for example.

(Hydrogen Content)

As one example, in Al alloy wire 22 of the embodiment, a content of hydrogen is less than or equal to 8.0 ml/100 g. One factor for the voids is considered to be hydrogen as described above. When the content of hydrogen per mass of 100 g of Al alloy wire 22 is less than or equal to 8.0 ml, the amount of voids is small in this Al alloy wire 22, whereby breaking resulting from the voids can be reduced as described above. As the content of hydrogen is smaller, it is considered that the amount of voids is smaller. Hence, the content of hydrogen is preferably less than or equal to 7.8 ml/100 g, less than or equal to 7.6 ml/100 g, or less than or equal to 7.0 ml/100 g. It is more preferable that the content of hydrogen is closer to 0. Regarding the hydrogen in Al alloy wire 22, it is considered that when casting is performed in an atmosphere including a water vapor such as an atmospheric air, the water vapor in the atmosphere is dissolved in a melt, with the result that the dissolved hydrogen remains therein. Therefore, for example, the content of hydrogen is likely to be reduced by lowering the temperature of melt to decrease the dissolution of the gas from the atmosphere. Moreover, the content of hydrogen tends to be decreased when Cu is contained.

(Characteristics)

Work Hardening Exponent

As one example, the work hardening exponent of Al alloy wire 22 of the embodiment is more than or equal to 0.05. Since the work hardening exponent is so large as to be more than or equal to 0.05, Al alloy wire 22 is facilitated to be work-hardened when subjected to plastic working as in obtaining a compressed strand wire by compressing a strand wire in which a plurality of Al alloy wires 22 are stranded or as in crimping terminal portion 4 to the end portion of conductor 2 (constituted of a solid wire, a strand wire, or a compressed strand wire) constituted of Al alloy wire(s) 22, for example. Even when the cross-sectional area is decreased due to the plastic working such as the compressing and the crimping, the strength is increased by the work hardening, whereby terminal portion 4 can be firmly fixed to conductor 2. Al alloy wire 22 having such a large work hardening exponent can constitute a conductor 2 excellent in fixation characteristic for terminal portion 4. As the work hardening exponent is larger, the strength is expected to be improved by the work hardening. Hence, the work hardening exponent is preferably more than or equal to 0.08 or more than or equal to 0.1. As the work hardening exponent is larger, the breaking elongation is likely to be larger. Accordingly, in order to increase the work hardening exponent, for example, the breaking elongation is increased by adjusting a type or content of an added element, a heat treatment condition, or the like. Al alloy wire 22 having such a specific structure that the sizes of the crystallized materials fall within the above-described specific range and the average crystal grain size falls within the above-described specific range is likely to have a work hardening exponent of more than or equal to 0.05. Therefore, the work hardening exponent can be adjusted by adjusting the type or content of the added element, the heat treatment condition, or the like with the structure of the Al alloy being used as an index.

Mechanical Characteristic and Electrical Characteristic

Since Al alloy wire 22 of the embodiment is composed of the Al alloy having the specific composition described above and is subjected to a heat treatment such as an aging treatment, Al alloy wire 22 of the embodiment has a high tensile strength, a high 0.2% proof stress, an excellent strength, a high electrical conductivity and an excellent electrical conductive property. Depending on composition, manufacturing condition, or the like, high breaking elongation and excellent toughness can be also obtained. Quantitatively, Al alloy wire 22 satisfies at least one selected from the following matters: the tensile strength is more than or equal to 150 MPa; the 0.2% proof stress is more than or equal to 90 MPa; the breaking elongation is more than or equal to 5%; and the electrical conductivity is more than or equal to 40% IACS. Al alloy wire 22 satisfying two, three, or particularly four, i.e., all, of the above-listed matters is more excellent in impact resistance and fatigue characteristic and is also excellent in electrical conductive property. Such an Al alloy wire 22 can be suitably utilized as a conductor of an electrical wire.

As the tensile strength is higher in the above-described range, the strength is more excellent, and the tensile strength can be more than or equal to 160 MPa, more than or equal to 180 more MPa, and more than or equal to 200 MPa. When the tensile strength is low, the breaking elongation and the electrical conductivity are likely to be increased.

As the breaking elongation is higher in the above-described range, the flexibility and toughness are more excellent and therefore the bending is more facilitated. Hence, the breaking elongation can be more than or equal to 6%, more than or equal to 7%, or more than or equal to 10%.

Since Al alloy wire 22 is representatively utilized for conductor 2, a higher electrical conductivity is more preferable. The electrical conductivity of Al alloy wire 22 is preferably more than or equal to 45% IACS, more than or equal to 48% IACS, or more than or equal to 50% IACS.

Al alloy wire 22 preferably also has a higher 0.2% proof stress. This is due to the following reason: when the tensile strength is the same, Al alloy wire 22 tends to be more excellent in fixation characteristic to terminal portion 4 as the 0.2% proof stress is higher. The 0.2 proof stress can be more than or equal to 95 MPa, more than or equal to 100 MPa, or more than or equal to 130 MPa.

In Al alloy wire 22, when the ratio of the 0.2% proof stress to the tensile strength is more than or equal to 0.5, the 0.2% proof stress is sufficiently large. Accordingly, the strength is high and breakage is less likely to occur, and the fixation characteristic to terminal portion 4 is also excellent as described above. As this ratio is larger, the strength is higher and the fixation characteristic to terminal portion 4 is more excellent. Hence, the ratio is preferably more than or equal to 0.55 or more than or equal to 0.6.

The tensile strength, 0.2% proof stress, breaking elongation, and electrical conductivity can be changed by adjusting a type or content of an added element or a manufacturing condition (wire drawing condition, heat treatment condition, or the like), for example. For example, when the amount of the added element is large, the tensile strength and the 0.2% proof stress tend to be high, whereas when the amount of the added element is small, the electrical conductivity tends to be high.

(Shape)

The transverse cross-sectional shape of Al alloy wire 22 of the embodiment can be appropriately selected in accordance with a purpose of use or the like. For example, a round wire having a circular transverse cross-sectional shape is employed (see FIG. 1). Alternatively, a quadrangular wire having a quadrangular transverse cross-sectional shape such as a rectangle or the like is employed. When Al alloy wire 22 constitutes an elemental wire of the above-described compressed strand wire, Al alloy wire 22 representatively has a deformed shape in which a circular shape is collapsed. For each of the measurement regions for evaluating the voids and the crystallized materials, a region in the shape of a rectangle is likely to be utilized in the case where Al alloy wire 22 is a quadrangular wire, whereas in the case where Al alloy wire 22 is a round wire or the like, a region in the shape of a rectangle or a sector may be utilized. In order to obtain a desired transverse cross-sectional shape of Al alloy wire 22, the shape of a wire drawing die, the shape of a compression die, or the like may be selected.

(Size)

The size (cross-sectional area, wire diameter (diameter) or the like in the case of a round wire) of Al alloy wire 22 of the embodiment can be selected appropriately in accordance with a purpose of use. For example, when Al alloy wire 22 is utilized for a conductor of an electrical wire included in each of various types of wire harnesses such as a wire harness for vehicles, the wire diameter of Al alloy wire 22 is more than or equal to 0.2 mm and less than or equal to 1.5 mm. For example, when Al alloy wire 22 is utilized for a conductor of an electrical wire for constructing a wiring structure in a building or the like, the wire diameter of Al alloy wire 22 is more than or equal to 0.1 mm and less than or equal to 3.6 mm. Since Al alloy wire 22 is a high-strength wire, Al alloy wire 22 is expected to be suitably utilizable for a purpose of use involving a wire having a smaller wire diameter such as a wire diameter of more than or equal to 0.1 mm and less than or equal to 1.0 mm.

[Al Alloy Strand Wire]

Al alloy wire 22 of the embodiment can be utilized for an elemental wire of a strand wire as shown in FIG. 1. An Al alloy strand wire 20 of the embodiment includes a plurality of Al alloy wires 22 stranded together. Since Al alloy strand wire includes the plurality of elemental wires (Al alloy wires 22) stranded together and each having a cross-sectional area smaller than that of a solid Al alloy wire having the same conductor cross-sectional area, Al alloy strand wire 20 is excellent in flexibility and is readily bent. Moreover, even though each of Al alloy wires 22 serving as the elemental wires is thin, Al alloy wires 22 are stranded, so that the strength is excellent as a whole of the strand wire. Furthermore, in Al alloy strand wire 20 of the embodiment, Al alloy wires 22 each having the specific surface property with a small dynamic friction coefficient are employed as the elemental wires. Hence, the elemental wires are likely to slide on one another, bending or the like can be performed smoothly, and the elemental wires are less likely to be broken when repeated bending is applied. In view of these, Al alloy wires 22 each serving as the elemental wire in Al alloy strand wire 20 are less likely to be broken even when an impact or repeated bending is applied, thus resulting in excellent impact resistance and fatigue characteristic, and resulting in a particularly excellent fatigue characteristic. Each of Al alloy wires 22 serving as the elemental wires is more excellent in impact resistance and fatigue characteristic when at least one selected from the surface roughness, the amount of adhesion of C, the content of the voids, the content of the hydrogen, the sizes or number of the crystallized materials, and the crystal grain sizes falls within the above-described specific range(s).

The number of wires stranded together in Al alloy strand wire 20 can be selected appropriately, such as 7, 11, 16, 19, or 37. The strand pitch of Al alloy strand wire 20 can be selected appropriately; however, when the strand pitch is more than or equal to 10 times as large as the pitch diameter of Al alloy strand wire 20, the wires are less likely to be unbound when attaching terminal portion 4 to the end portion of conductor 2 constituted of Al alloy strand wires 20, thus resulting in excellent operability in attaching terminal portion 4. On the other hand, when the strand pitch is less than or equal to 40 times as large as the pitch diameter, the elemental wires are less likely to be twisted when bending or the like is applied and breakage is less likely to occur, thus resulting in an excellent fatigue characteristic. In consideration of prevention of the unbinding and prevention of the twisting, the strand pitch can be more than or equal to 15 times and less than or equal to 35 times or more than or equal to 20 times and less than or equal to 30 times as large as the pitch diameter.

Al alloy strand wire 20 can be compressed into a compressed strand wire. In this case, the wire diameter can be smaller than that in the state where the elemental wires are merely stranded, or the outer shape can be formed into a desired shape (for example, a circular shape). When the work hardening exponent of each Al alloy wire 22 serving as the elemental wire is large as described above, it can be expected to improve the strength and also improve the impact resistance and the fatigue characteristic.

The specifications of each Al alloy wire 22 included in Al alloy strand wire 20 such as the composition, the structure, the surface property, the thickness of the surface oxide film, the content of hydrogen, the amount of adhesion of C, the mechanical characteristic, and the electrical characteristic, are maintained to be substantially the same as the specifications of Al alloy wire 22 before being stranded. The thickness of the surface oxide film, the amount of adhesion of C, the mechanical characteristic, and the electrical characteristic may be changed by use of a lubricant during the stranding, application of a heat treatment after the stranding, or the like. The stranding conditions may be adjusted in order to obtain desired values for the specifications of Al alloy strand wire 20.

[Covered Electrical Wire]

Each of Al alloy wire 22 of the embodiment and Al alloy strand wire 20 (or the compressed strand wire) of the embodiment can be utilized suitably for a conductor for an electrical wire. Each of Al alloy wire 22 of the embodiment and Al alloy strand wire 20 (or the compressed strand wire) of the embodiment can be utilized for both of a bare conductor including no insulation cover and a conductor of a covered electrical wire including an insulation cover. A covered electrical wire 1 of the embodiment includes conductor 2 and an insulation cover 3 that covers the outer circumference of conductor 2, wherein Al alloy wire 22 of the embodiment or Al alloy strand wire 20 of the embodiment is included as conductor 2. Since this covered electrical wire 1 includes conductor 2 constituted of Al alloy wire 22 or Al alloy strand wire 20 excellent in impact resistance and fatigue characteristic, covered electrical wire 1 is excellent in impact resistance and fatigue characteristic. An insulating material of insulation cover 3 can be selected appropriately. For the insulating material, a known material can be utilized, such as a polyvinyl chloride (PVC) or non-halogen resin, or a material excellent in incombustibility. The thickness of insulation cover 3 can be selected appropriately as long as a predetermined insulating strength is attained.

[Terminal-Equipped Electrical Wire]

Covered electrical wire 1 of the embodiment can be utilized for electrical wires for various purposes of use, such as: wire harnesses in devices of vehicles and airplanes; wires of various electric devices such as industrial robots; and wires in buildings. When included in a wire harness or the like, terminal portion 4 is attached to the end portion of covered electrical wire 1, representatively. As shown in FIG.

Figure 2:
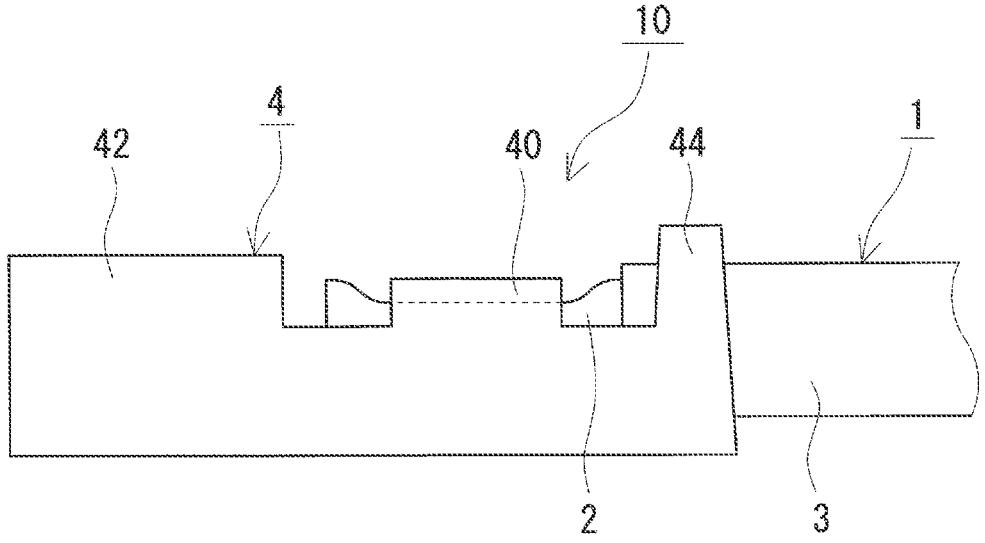
FIG. 2 is a schematic side view showing a vicinity of a terminal portion in a terminal-equipped electrical wire according to the embodiment.

2, terminal-equipped electrical wire 10 of the embodiment includes: covered electrical wire 1 of the embodiment; and terminal portion 4 attached to the end portion of covered electrical wire 1. Since this terminal-equipped electrical wire 10 includes covered electrical wire 1 excellent in impact resistance and fatigue characteristic, terminal-equipped electrical wire 10 is excellent in impact resistance and fatigue characteristic. In FIG. 2, as terminal portion 4, a crimp terminal is illustrated which includes: a female or male fitting portion 42 at one end; an insulation barrel portion 44 at the other end, insulation barrel portion 44 being configured to hold insulation cover 3; and a wire barrel portion 40 at the intermediate portion, wire barrel portion 40 being configured to hold conductor 2. Other examples of terminal portion 4 include a molten type terminal portion connected by melting conductor 2.

The crimp terminal is crimped to the end portion of conductor 2 exposed as a result of removal of insulation cover 3 at the end portion of covered electrical wire 1 and is therefore electrically and mechanically connected to conductor 2. When Al alloy wire 22 or Al alloy strand wire 20 included in conductor 2 has a high work hardening exponent as described above, a portion of conductor 2 to which the crimp terminal is attached is excellent in strength due to work hardening although the cross-sectional area of the portion is small locally. Accordingly, for example, even in the case where an impact is applied when connecting terminal portion 4 to a connection position of covered electrical wire 1 and even in the case where repeated bending is applied after making the connection, breakage of conductor 2 in the vicinity of terminal portion 4 can be reduced, whereby this terminal-equipped electrical wire 10 is excellent in impact resistance and fatigue characteristic.

When the amount of adhesion of C is small or the surface oxide film is thin as described above in each of Al alloy wire 22 and Al alloy strand wire 20 of conductor 2, an electrical insulator between conductor 2 and terminal portion 4 (a lubricant including C, an oxide included in the surface oxide film, or the like) can be reduced, thus resulting in a reduced connection resistance between conductor 2 and terminal portion 4. Therefore, this terminal-equipped electrical wire 10 is excellent in impact resistance and fatigue characteristic and is small in connection resistance.

For terminal-equipped electrical wire 10, the following embodiments can be exemplified: an embodiment in which one terminal portion 4 is attached for each covered electrical wire 1 as shown in FIG. 2; and an embodiment in which one terminal portion (not shown) is provided for a plurality of covered electrical wires 1. When the plurality of covered electrical wires 1 are bundled using a bundling tool or the like, terminal-equipped electrical wire 10 can be readily handled.

[Method of Manufacturing Al Alloy Wire and Method of Manufacturing Al

Alloy Strand Wire]

(Overview)

Al alloy wire 22 of the embodiment can be manufactured representatively by performing a heat treatment (inclusive of an aging treatment) at an appropriate timing in addition to basic steps of intermediate work, such as casting, (hot) rolling and extrusion, and wire drawing. For conditions of the basic steps, the aging treatment, and the like, known conditions or the like can be employed. Al alloy strand wire 20 of the embodiment can be manufactured by stranding the plurality of Al alloy wires 22 together. For conditions of the stranding, known conditions can be employed. Al alloy wire 22 of the embodiment with the small dynamic friction coefficient can be manufactured by mainly adjusting the wire drawing condition and the heat treatment condition as described below.

(Casting Step)

Al alloy wire 22 having a small amount of voids in the surface layer can be likely to be manufactured by setting the temperature of melt at a low temperature in the casting process, for example. The dissolution of the gas in the melt from the atmosphere can be reduced, whereby the cast material can be manufactured using the melt having a small amount of the dissolved gas. Examples of the dissolved gas include hydrogen as described above. It is considered that this hydrogen is decomposed from water vapor in the atmosphere, or is included in the atmosphere. By employing, as a base material, the cast material including such a small amount of the dissolved gas such as dissolved hydrogen, the state with the small amount of voids resulting from the dissolved gas in the Al alloy is readily maintained after the casting even in the case where plastic working such as rolling or wire drawing or a heat treatment such as an aging treatment is performed. As a result, the voids in the surface layer or inner portion of Al alloy wire 22 having the final wire diameter can fall within the above-described specific range. Moreover, Al alloy wire 22 having a small content of hydrogen can be manufactured as described above. By performing steps after the casting process, such as stripping and processes involving plastic deformation (such as rolling, extrusion, and wire drawing), it is considered that the positions of the voids confined in the Al alloy are changed or the sizes of the voids becomes small to some extent. However, when the total content of the voids in the cast material is large, it is considered that the total content of the voids or the content of hydrogen in the surface layer or the inner portion is likely to be large (maintained substantially) in the Al alloy wire having the final wire diameter even if the positions and sizes of the voids are changed. In view of this, it is proposed to lower the temperature of melt so as to sufficiently reduce the voids included in the cast material.

As a specific example of the temperature of melt, the temperature of melt is more than or equal to a liquidus temperature in the Al alloy and less than 750° C. As the temperature of melt is lower, the dissolved gas can be reduced to reduce the voids of the cast material. Hence, the temperature of melt is preferably less than or equal to 748° C. or less than or equal to 745° C. On the other hand, when the temperature of melt is high to some extent, the added element is likely to be dissolved in the solid state. Hence, the temperature of melt can be more than or equal to 670° C. or more than or equal to 675° C. With such a low temperature of melt, the amount of the dissolved gas can be reduced even when the casting is performed in an atmosphere including water vapor such as an atmospheric air, thereby reducing the total content of the voids resulting from the dissolved gas and the content of hydrogen.

By increasing the cooling rate in the casting process particularly in the specific temperature range from the temperature of melt to 650° C. in addition to lowering the temperature of melt, the dissolved gas from the atmosphere is likely to be prevented from being increased. This is due to the following reason: in the above-described specific temperature range, which is mainly a liquid phase range, hydrogen or the like is likely to be dissolved and the dissolved gas is likely to be increased. On the other hand, since the cooling rate in the above-described specific temperature range is not too fast, it is considered that the dissolved gas in the metal that is in the course of solidification is likely to be discharged to the outside, i.e., to the atmosphere. In consideration of the suppression of increase of the dissolved gas, the cooling rate is preferably more than or equal to 1° C./second, more than or equal to 2° C./second, or more than or equal to 4° C./second. In consideration of promoting the discharging of the dissolved gas from inside the metal, the cooling rate can be less than or equal to 30° C./second, less than 25° C./second, less than or equal to 20° C./second, less than 20° C./second, less than or equal to 15° C./second, or less than or equal to 10° C./second. Since the above-described cooling rate is not too fast, it is suitable also for mass production. Depending on a cooling rate, a supersaturated solid solution can be employed. In this case, a solution treatment in a step after the casting may be omitted or may be performed separately.

The following knowledge was obtained: when the cooling rate is set to be fast to some extent in the specific temperature range in the casting process as described above, Al alloy wire 22 including the certain amount of the fine crystallized materials can be manufactured. Here, the specific temperature range is mainly the liquid phase range as described above. By making the cooling rate faster in the liquid phase range, the sizes of the crystallized materials generated during solidification are likely to be small. However, it is considered that when the temperature of melt is made low as described above, if the cooling rate is too fast, particularly, if the cooling rate is more than or equal to 25° C./second, the crystallized materials are less likely to be generated, with the result that the amount of dissolution of the added element in the solid state is increased to cause a decreased electrical conductivity or a pinning effect for the crystal grains by the crystallized materials is less likely to be obtained. On the other hand, by setting the temperature of melt to be low and making the cooling rate fast to some extent in the above-described temperature range as described above, coarse crystallized materials are less likely to be included and a certain amount of fine crystallized materials having a comparatively uniform size is likely to be included. Finally, Al alloy wire 22 having a small amount of voids in the surface layer and including a certain amount of fine crystallized materials can be manufactured. In order to obtain fine crystallized materials, the cooling rate is preferably more than 1° C./second or more than or equal to 2° C./second although depending on the contents of the added elements such as Mg and Si and element a. In view of the above, the temperature of melt is more preferably more than or equal to 670° C. and less than 750° C., and the cooling rate is more preferably less than 20° C./second in the range from the temperature of melt to 650° C.

Further, when the cooling rate in the casting process is set to be faster in the above-described range, the following effects can be expected: a cast material having a fine crystalline structure is likely to be obtained; the added element is likely to be dissolved in the solid state to some extent; and DAS (Dendrite Arm Spacing) is likely to be small (for example, less than or equal to 50 μm or less than or equal to 40 μm).

For the casting, both continuous casting and metal mold casting (billet casting) can be utilized. In the continuous casting, a long cast material can be manufactured continuously and the cooling rate can be readily increased, whereby the above-described effects can be expected, such as: the reduction of the voids; the suppression of the coarse crystallized materials; the attainment of fine crystal grains or fine DAS; the dissolution of the added element in the solid state; and the formation of the supersaturated solid solution depending on a cooling rate.

(Steps Until Wire Drawing)

An intermediate work material obtained by performing plastic working (intermediate working), such as (hot) rolling and extrusion, to the cast material is used for wire drawing, for example. By performing the hot-rolling successively to the continuous casting, a continuous cast and rolled material (exemplary intermediate work material) can be also used for wire drawing. Stripping or a heat treatment can be performed before and after the above-described plastic working. By performing the stripping, a surface layer that can include voids or surface scratches can be removed. The heat treatment herein is intended to achieve homogenization, solution or the like of the Al alloy, for example. For example, conditions of the homogenization process are as follows: the atmosphere is an atmospheric air or a reducing atmosphere; the heating temperature is about more than or equal to 450° C. (preferably, more than or equal to 500° C.) and less than or equal to 600° C.; the holding time is more than or equal to 1 hour (preferably more than or equal to 3 hours) and less than or equal to 10 hours; and the cooling rate is gradual such as 1° C./minute. When the homogenization process is performed to the intermediate work material before the wire drawing under the above conditions, Al alloy wire 22 having a high breaking elongation and an excellent toughness is readily manufactured. When the intermediate work material is the continuous cast and rolled material, Al alloy wire 22 having a more excellent toughness is readily manufactured. For conditions of the solution treatment, below-described conditions can be used.

(Wire Drawing Step)

The material (intermediate work material) having been through the plastic working such as the rolling is subjected to a (cold) drawing process until a predetermined wire diameter is attained, thereby forming a wire-drawn member. The wire drawing is representatively performed using a wire drawing die. Moreover, the wire drawing is performed using the lubricant. By using the wire drawing die having a small surface roughness of, for example, less than or equal to 3 μm as described above and by adjusting the amount of the lubricant, Al alloy wire 22 having a smooth surface having a surface roughness of less than or equal to 3 μm can be manufactured. By appropriately changing to a wire drawing die having a small surface roughness, a wire-drawn member having a smooth surface can be manufactured continuously. The surface roughness of the wire drawing die can be readily measured by using the surface roughness of the wire-drawn member as an alternative value therefor, for example. By adjusting the amount of application of the lubricant or adjusting the below-described heat treatment condition, Al alloy wire 22 can be manufactured in which the amount of adhesion of C on the surface of Al alloy wire 22 falls within the above-described specific range. Accordingly, Al alloy wire 22 of the embodiment having a dynamic friction coefficient falling within the above-described specific range can be manufactured. A degree of wire drawing can be selected appropriately in accordance with the final wire diameter.

(Stranding Step)

When manufacturing Al alloy strand wire 20, a plurality of wire members (wire-drawn members or heated members having been through a heat treatment after the wire drawing) are prepared and are stranded together at a predetermined strand pitch (for example, 10 to 40 times as large as the pitch diameter). A lubricant may be used upon the stranding. When Al alloy strand wire 20 is a compressed strand wire, Al alloy strand wire 20 is compressed into a predetermined shape after the stranding.

(Heat Treatment)

The wire-drawn member at an appropriate timing during the wire drawing or after the wire-drawing step can be subjected to a heat treatment. For example, the intermediate heat treatment performed during the wire drawing is intended to remove strain introduced during the wire drawing and improve workability. The heat treatment after the wire-drawing step is intended for a solution treatment, an aging treatment, or the like. It is preferable to at least perform the heat treatment intended for the aging treatment. This is due to the following reason: with the aging treatment, the precipitated materials including the added elements such as Mg and Si and, depending on a composition, element a (such as Zr) can be dispersed in the Al alloy, with the result that the strength can be improved due to age hardening and the electrical conductivity can be improved due to decrease of the elements dissolved in the solid state. As a result, Al alloy wire 22 or Al alloy strand wire 20 each having a high strength, a high toughness, an excellent impact resistance and an excellent fatigue characteristic can be manufactured. As the timing for the heat treatment, at least one of the following timings can be employed: a timing during the wire drawing; a timing after the wire drawing (before the stranding); a timing after the stranding (before the compressing); and a timing after the compressing. The heat treatment may be performed at a plurality of timings. In the case where the solution treatment is performed, the solution treatment is performed before the aging treatment (the solution treatment may not be performed immediately before the aging treatment). By performing the intermediate heat treatment, solution treatment, and the like during the wire drawing or before the stranding, workability is improved, thus facilitating the wire drawing, the stranding, and the like. The heat treatment conditions may be adjusted such that the characteristics after the heat treatment falls within desired ranges. For example, by performing the heat treatment to achieve a breaking elongation of more than or equal to 5%, Al alloy wire 22 having a work hardening exponent falling within the above-described specific range can also be manufactured. Moreover, the heat treatment conditions can be adjusted in order to achieve a desired value of a remaining amount of the lubricant after the heat treatment with the amount of lubricant being measured before the heat treatment. As the heating temperature is higher or as the holding time is longer, the remaining amount of the lubricant tends to be smaller.

The heat treatment can be utilized for both of: a continuous process in which a subject for the heat treatment is continuously supplied to a heating container such as a pipe furnace or an electric furnace so as to perform heating; and a batch process in which a subject for the heat treatment is sealed hermetically in a heating container such as an atmosphere furnace. In the continuous process, for example, the temperature of the wire member is measured using a non-contact type thermometer and a control parameter is adjusted such that the characteristics after the heat treatment fall within the predetermined ranges. Specific conditions of the batch process are, for example, as follows.

(Solution Treatment) The heating temperature is about more than or equal to 450° C. and less than or equal to 620° C. (preferably more than or equal to 500° C. and less than or equal to 600° C.), the holding time is more than or equal to 0.005 second and less than or equal to 5 hours (preferably, more than or equal to 0.01 second and less than or equal to 3 hours), and the cooling rate is fast, such as more than or equal to 100° C./minute or more than or equal to 200° C./minute.

(Intermediate Heat Treatment) The heating temperature is more than or equal to 250° C. and less than or equal to 550° C., and the heating time is more than or equal to 0.01 second and less than or equal to 5 hours.

(Aging Treatment) The heating temperature is more than or equal to 100° C. and less than or equal to 300° C. or more than or equal to 140° C. and less than or equal to 250° C., and the holding time is more than or equal to 4 hours and less than or equal to hours or less than or equal to 16 hours.

Examples of the atmosphere in the heat treatment include: an atmosphere having a comparatively large oxygen content such as an atmospheric air; and a low-oxygen atmosphere having a smaller oxygen content than that of the atmospheric air.

In the case of the atmospheric air, it is unnecessary to control the atmosphere; however, a surface oxide film is likely to be formed to be thick (for example, more than or equal to 50 nm). Hence, when the atmospheric air is employed, Al alloy wire 22 in which the thickness of the surface oxide film falls within the above-described specific range is likely to be manufactured by employing a short holding time and employing the continuous process. Examples of the low-oxygen atmosphere include a vacuum atmosphere (decompressed atmosphere); an inert gas atmosphere; a reducing gas atmosphere; and the like. Examples of the inert gas include nitrogen, argon, and the like. Examples of the reducing gas include: hydrogen gas; hydrogen-mixed gas including hydrogen and an inert gas; and mixed gas of carbon monoxide and carbon dioxide; and the like. In the case of the low-oxygen atmosphere, it is necessary to control the atmosphere; however, the surface oxide film is likely to be thin (for example, less than 50 nm). Accordingly, when the low-oxygen atmosphere is employed, by employing the batch process in which the atmosphere is readily controlled, Al alloy wire 22 in which the thickness of the surface oxide film falls within the above-described specific range, preferably, Al alloy wire 22 in which the thickness of the surface oxide film is thinner is likely to be manufactured.

By adjusting the composition of the Al alloy (preferably adding both Ti and B, and an element having a fine crystal attaining effect in element a) and using the continuous cast material or continuous cast and rolled material for the base material as described above, Al alloy wire 22 in which the crystal grain sizes fall within the above-described range is likely to be manufactured. Particularly, when a degree of wire drawing from the base material obtained by performing plastic working such as rolling onto the continuous cast material or from the continuous cast and rolled material to the wire-drawn member having the final wire diameter is set to more than or equal to 80% and when the heat treatment (particularly, aging treatment) is performed to achieve a breaking elongation of more than or equal to 5% in the wire-drawn member having the final wire diameter, the strand wire, or the compressed strand wire, Al alloy wire 22 in which the crystal grain sizes are less than or equal to 50 μm is more likely to be manufactured. In this case, the heat treatment may be also performed during the wire drawing. By controlling the crystalline structure and controlling the breaking elongation in this way, Al alloy wire 22 in which the work hardening exponent falls within the above-described specific range can also be manufactured.

(Other Steps)

In addition, as a method of adjusting the thickness of the surface oxide film, the following methods are considered: a method of exposing the wire-drawn member having the final wire diameter to a hot water at a high temperature and a high pressure; a method of applying water to the wire-drawn member having the final wire diameter; a method including a drying step after water cooling in the case where the water cooling is performed after the heat treatment in the continuous process under the atmospheric air; and the like. By exposing to hot water or applying water, the surface oxide film tends to be thick. By drying after the water cooling, a boehmite layer is prevented from being formed due to the water cooling, whereby the surface oxide film tends to be thin. When a mixture of water and ethanol is used as coolant for the water cooling, degreasing can be performed at the same time as the cooling.

When a small amount of lubricant or substantially no lubricant is adhered to the surface of Al alloy wire 22 as a result of the heat treatment, the degreasing treatment, or the like, lubricant can be applied to attain a predetermined amount of adhesion of lubricant. On this occasion, the amount of adhesion of the lubricant can be adjusted using the amount of adhesion of C and the dynamic friction coefficient as indices. For the degreasing treatment, a known method can be utilized. The degreasing treatment can be performed at the same time as the cooling as described above.

[Method of Manufacturing Covered Electrical Wire]

Covered electrical wire 1 of the embodiment can be manufactured by: preparing Al alloy wire 22 or Al alloy strand wire 20 (or the compressed strand wire) of the embodiment constituting conductor 2; and forming insulation cover 3 on the outer circumference of conductor 2 through extrusion or the like. For the extrusion condition, a known condition can be employed.

[Method of Manufacturing Terminal-Equipped Electrical Wire]

Terminal-equipped electrical wire 10 of the embodiment can be manufactured by: removing insulation cover 3 from the end portion of covered electrical wire 1 to expose conductor 2; and attaching terminal portion 4 thereto.

Test Example 1

Al alloy wires were produced under various conditions and characteristics thereof were examined. Moreover, Al alloy strand wires were produced using these Al alloy wires. Further, covered electrical wires employing these Al alloy strand wires as conductors were produced. Crimp terminals were attached to the end portions of the covered electrical wires, and characteristics of the terminal-equipped electrical wires thus obtained were examined.

Figures 5, 6:
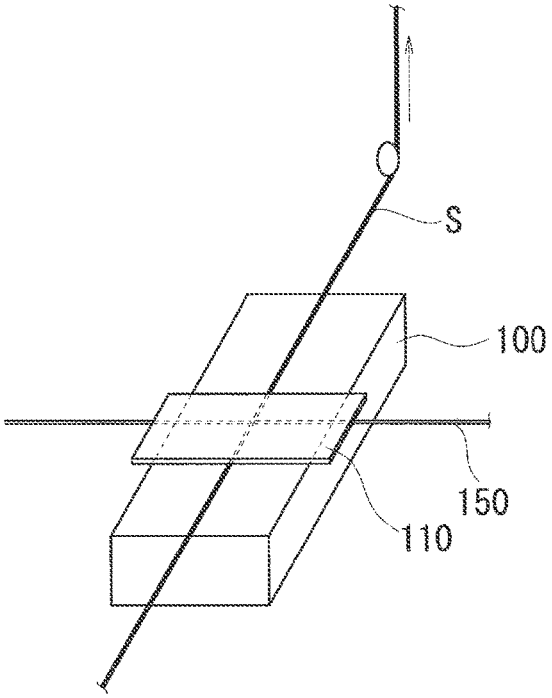
FIG. 5 is an explanatory drawing illustrating a method of measuring a dynamic friction coefficient.
FIG. 6 is an explanatory drawing illustrating a manufacturing process for the aluminum alloy wire.

In this test, steps each shown in a manufacturing method A to a manufacturing method G are performed sequentially as shown in FIG. 6 to produce a wire rod (WR) and finally manufacture an aged member. Specific steps are as follows. In each manufacturing method, steps with check marks in the first column of FIG. 6 are performed.

WR→wire drawing→heat treatment(solution treatment)→aging (Manufacturing Method A)

WR→heat treatment(solution treatment)→wire drawing→aging (Manufacturing Method B)

WR→heat treatment(solution treatment)→wire drawing→heat treatment (solution treatment)→aging (Manufacturing Method C)

WR→stripping→wire drawing→intermediate heat treatment→wire drawing→heat treatment(solution treatment)→aging (Manufacturing Method D)

WR→heat treatment(solution treatment)→stripping→wire drawing→intermediate heat treatment→wire drawing→heat treatment(solution treatment)→aging (Manufacturing Method E)

WR→wire drawing→aging (Manufacturing Method F)

WR→heat treatment(solution treatment;batch)→wire drawing→aging (Manufacturing Method G)

Each of samples No. 1 to No. 71, No. 101 to No. 106 and No. 111 to No. 119 is a sample manufactured by manufacturing method C. Samples No. 72 to No. 77 are samples respectively manufactured by manufacturing methods A, B, and D to G. Hereinafter, specific manufacturing processes in manufacturing method C will be described. In each of the manufacturing methods other than manufacturing method C, the same steps as those in manufacturing method C are performed under the same conditions. In each of manufacturing methods D and E, the stripping is performed to remove a surface of the wire member by a thickness of about 150 μm, and the intermediate heat treatment is a high-frequency induction-heating type continuous process (wire member temperature: about 300° C.). The solution treatment in manufacturing method G is a batch process with a condition of 540° C.×3 hours.

Pure aluminum (more than or equal to 99.7 mass % of Al) is prepared as a base and is melted to obtain a melt (molten aluminum). Then, added elements are introduced into the obtained melt (molten aluminum) to attain respective contents (mass %) shown in Table 1 to Table 4, thereby producing a melt of the Al alloy. When the melt of the Al alloy, which has been through component adjustment, is subjected to a hydrogen gas removing process or a foreign matter removing process, the content of hydrogen is likely to be reduced and the foreign matter is likely to be reduced.

A continuous cast and rolled material or billet cast material is produced using the prepared melt of the Al alloy. The continuous cast and rolled material is produced by continuously performing casting and hot rolling using a belt wheel type continuous casting roller and the prepared melt of the Al alloy, and is formed into a wire rod with ϕ of 9.5 mm. The billet cast material is produced by introducing the melt of the Al alloy into a predetermined fixed mold and cooling the melt of the Al alloy. The billet cast material is subjected to a homogenization process and is then subjected to hot rolling, thereby producing a wire rod (rolled material) with ϕ of 9.5 mm. Each of Table 5 to Table 8 shows: a type of casting method (the continuous cast and rolled material is indicated as "Continuous" and the billet cast material is indicated as "Billet"); the temperature of melt (° C.); and a cooling rate (average cooling rate from the temperature of melt to 650° C. based on ° C./second as a unit) in the casting process. The cooling rate is changed by adjusting the cooling state using a water-cooling mechanism or the like.

Each of the above-described wire rods is subjected to the solution treatment (batch process) under a condition of 530° C.×5 hours and is then subjected to a cold wire-drawing process to produce a wire-drawn member having a wire diameter ϕ of 0.3 mm, a wire-drawn member having a wire diameter ϕ of 0.25 mm, and a wire-drawn member having a wire diameter ϕ of 0.32 mm. Here, the wire drawing is performed using a wire drawing die and a commercially available lubricant (oil including carbon). The respective surface roughnesses of the wire-drawn members of the samples are adjusted by preparing wire drawing dies having different surface roughnesses, appropriately changing among the wire drawing dies, and appropriately adjusting the amount of use of the lubricant. For a sample No. 115, a wire drawing die having the largest surface roughness is used.

After performing the solution treatment to the obtained wire-drawn member having a wire diameter ϕ of 0.3 mm, the wire-drawn member is subjected to an aging treatment, thereby producing an aged member (Al alloy wire). The solution treatment is a high-frequency induction-heating type continuous process in which the temperature of the wire member is measured using a noncontact type infrared thermometer and a power supply condition is controlled to attain a wire member temperature of more than or equal to 300° C. The aging treatment is a batch process employing a box-shaped furnace and is performed with temperature (° C.), time (hour (H)), and atmosphere shown in Table 5 to Table 8. A sample No. 116 is subjected to a boehmite treatment (100° C.×15 minutes) after the aging treatment in the atmospheric air (indicated as "*" in the column of the atmosphere in Table 8).

TABLE 1

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 1 | 0.03 | 0.04 | 0.8 | 0.15 | — | — | — | — | — | — | — | 0.15 | 0.22 | 0.01 | 0.002 |
| 2 | 0.03 | 0.02 | 1.5 | — | 0.2 | — | — | — | — | — | — | 0.2 | 0.25 | 0.01 | 0.002 |
| 3 | 0.2 | 0.06 | 3.3 | — | — | — | — | — | — | — | — | 0 | 0.26 | 0.01 | 0.002 |
| 4 | 0.2 | 0.1 | 2.0 | — | — | — | — | — | — | — | — | 0 | 0.3 | 0.02 | 0.004 |
| 5 | 0.2 | 0.25 | 0.8 | — | — | — | — | — | — | — | — | 0 | 0.45 | 0.01 | 0.002 |
| 6 | 0.35 | 0.1 | 3.5 | — | — | — | — | — | — | — | — | 0 | 0.45 | 0 | 0 |
| 7 | 0.5 | 0.15 | 3.3 | — | — | — | — | — | — | — | — | 0 | 0.65 | 0.01 | 0.002 |
| 8 | 0.5 | 0.2 | 2.5 | — | — | — | — | — | — | — | — | 0 | 0.7 | 0.02 | 0.004 |
| 9 | 0.55 | 0.32 | 1.7 | — | 0.1 | — | — | — | — | — | — | 0.1 | 0.97 | 0.02 | 0 |
| 10 | 0.5 | 0.5 | 1.0 | — | — | — | — | — | — | — | — | 0 | 1 | 0.01 | 0.002 |
| 11 | 0.6 | 0.22 | 2.7 | — | — | — | — | — | — | — | — | 0 | 0.82 | 0.02 | 0.004 |
| 12 | 0.6 | 0.5 | 1.2 | — | — | — | — | — | — | — | — | 0 | 1.1 | 0.01 | 0.002 |
| 13 | 1 | 0.4 | 2.5 | — | — | — | — | — | — | — | — | 0 | 1.4 | 0.01 | 0 |
| 14 | 1 | 1 | 1.0 | — | — | — | — | — | — | — | — | 0 | 2 | 0.01 | 0.002 |
| 15 | 1 | 1.2 | 0.8 | — | — | — | — | — | — | — | — | 0 | 2.2 | 0.02 | 0.004 |
| 16 | 1.5 | 0.5 | 3.0 | — | — | — | — | — | — | — | — | 0 | 2 | 0.02 | 0.004 |
| 17 | 1.5 | 1 | 1.5 | — | — | — | — | — | — | — | — | 0 | 2.5 | 0 | 0 |
| 18 | 1.5 | 2 | 0.8 | — | — | — | — | — | — | — | — | 0 | 3.5 | 0.008 | 0.002 |

TABLE 2

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 19 | 0.5 | 0.5 | 1.0 | 0.05 | — | — | — | — | — | — | — | 0.05 | 1.05 | 0.03 | 0.005 |
| 20 | 0.5 | 0.5 | 1.0 | 0.1 | — | — | — | — | — | — | — | 0.1 | 1.1 | 0.05 | 0.005 |
| 21 | 0.5 | 0.5 | 1.0 | 0.25 | — | — | — | — | — | — | — | 0.25 | 1.25 | 0.01 | 0.002 |
| 22 | 0.5 | 0.5 | 1.0 | — | 0.05 | — | — | — | — | — | — | 0.05 | 1.05 | 0.01 | 0.002 |
| 23 | 0.5 | 0.5 | 1.0 | — | 0.1 | — | — | — | — | — | — | 0.1 | 1.1 | 0.01 | 0 |
| 24 | 0.5 | 0.5 | 1.0 | — | 0.5 | — | — | — | — | — | — | 0.5 | 1.5 | 0.01 | 0 |
| 25 | 0.5 | 0.5 | 1.0 | — | — | 0.05 | — | — | — | — | — | 0.05 | 1.05 | 0.03 | 0.015 |
| 26 | 0.5 | 0.5 | 1.0 | — | — | 0.5 | — | — | — | — | — | 0.5 | 1.5 | 0.02 | 0.004 |
| 27 | 0.5 | 0.5 | 1.0 | — | — | — | 0.05 | — | — | — | — | 0.05 | 1.05 | 0.02 | 0.004 |
| 28 | 0.5 | 0.5 | 1.0 | — | — | — | 0.5 | — | — | — | — | 0.5 | 1.5 | 0.01 | 0.002 |
| 29 | 0.5 | 0.5 | 1.0 | — | — | — | — | 0.05 | — | — | — | 0.05 | 1.05 | 0.01 | 0.002 |
| 30 | 0.5 | 0.5 | 1.0 | — | — | — | — | 0.5 | — | — | — | 0.5 | 1.5 | 0.02 | 0.004 |
| 31 | 0.5 | 0.5 | 1.0 | — | — | — | — | — | 0.05 | — | — | 0.05 | 1.05 | 0.01 | 0.002 |
| 32 | 0.5 | 0.5 | 1.0 | — | — | — | — | — | 0.5 | — | — | 0.5 | 1.5 | 0.02 | 0.004 |
| 33 | 0.5 | 0.5 | 1.0 | — | — | — | — | — | — | 0.05 | — | 0.05 | 1.05 | 0.01 | 0.002 |
| 34 | 0.5 | 0.5 | 1.0 | — | — | — | — | — | — | 0.5 | — | 0.5 | 1.5 | 0.01 | 0.002 |
| 35 | 0.5 | 0.5 | 1.0 | — | — | — | — | — | — | — | 0.05 | 0.05 | 1.05 | 0.02 | 0.004 |
| 36 | 0.5 | 0.5 | 1.0 | — | — | — | — | — | — | — | 0.1 | 0.1 | 1.1 | 0.03 | 0.005 |
| 37 | 0.5 | 0.5 | 1.0 | 0.01 | — | — | — | — | — | — | — | 0.01 | 1.01 | 0.02 | 0.004 |
| 38 | 0.5 | 0.5 | 1.0 | 0.01 | 0.01 | 0.01 | 0.01 | 0.01 | 0.01 | 0.01 | 0.01 | 0.08 | 1.08 | 0.01 | 0.002 |
| 39 | 0.5 | 0.5 | 1.0 | 0.01 | — | 0.03 | — | — | — | — | 0.01 | 0.05 | 1.05 | 0.02 | 0.004 |
| 40 | 0.5 | 0.5 | 1.0 | 0.1 | 0.05 | — | — | — | — | — | — | 0.15 | 1.15 | 0 | 0 |
| 41 | 0.5 | 0.5 | 1.0 | 0.1 | — | 0.05 | — | — | — | — | — | 0.15 | 1.15 | 0.02 | 0.004 |
| 42 | 0.5 | 0.5 | 1.0 | 0.1 | — | — | 0.05 | — | — | — | — | 0.15 | 1.15 | 0.02 | 0.004 |
| 43 | 0.5 | 0.5 | 1.0 | 0.1 | — | — | — | 0.05 | — | — | — | 0.15 | 1.15 | 0.01 | 0.002 |
| 44 | 0.5 | 0.5 | 1.0 | 0.1 | — | — | — | — | 0.05 | — | — | 0.15 | 1.15 | 0.03 | 0.005 |
| 45 | 0.5 | 0.5 | 1.0 | 0.1 | — | — | — | — | — | 0.05 | — | 0.15 | 1.15 | 0.02 | 0.004 |
| 46 | 0.5 | 0.5 | 1.0 | 0.1 | — | — | — | — | — | — | 0.005 | 0.105 | 1.105 | 0.02 | 0.004 |
| 47 | 0.67 | 0.52 | 1.3 | 0.13 | — | — | — | 0.05 | — | — | — | 0.18 | 1.37 | 0.02 | 0.004 |

TABLE 3

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 48 | 0.5 | 0.5 | 1.0 | 0.1 | 0.05 | 0.05 | — | — | — | — | — | 0.2 | 1.2 | 0.01 | 0 |
| 49 | 0.5 | 0.5 | 1.0 | 0.1 | 0.05 | — | 0.05 | — | — | — | — | 0.2 | 1.2 | 0.02 | 0.004 |
| 50 | 0.5 | 0.5 | 1.0 | 0.1 | 0.05 | — | — | 0.05 | — | — | — | 0.2 | 1.2 | 0.02 | 0.004 |
| 51 | 0.5 | 0.5 | 1.0 | 0.1 | 0.05 | — | — | — | 0.05 | — | — | 0.2 | 1.2 | 0.02 | 0 |
| 52 | 0.5 | 0.5 | 1.0 | 0.1 | 0.05 | — | — | — | — | 0.05 | — | 0.2 | 1.2 | 0.01 | 0.002 |
| 53 | 0.5 | 0.5 | 1.0 | 0.1 | 0.05 | — | — | — | — | — | 0.01 | 0.16 | 1.16 | 0.02 | 0.004 |
| 54 | 0.5 | 0.5 | 1.0 | 0.1 | — | 0.05 | 0.05 | — | — | — | — | 0.2 | 1.2 | 0.02 | 0.004 |
| 55 | 0.5 | 0.5 | 1.0 | 0.1 | — | 0.05 | — | 0.05 | — | — | — | 0.2 | 1.2 | 0.01 | 0.002 |
| 56 | 0.5 | 0.5 | 1.0 | 0.1 | — | 0.05 | — | — | 0.05 | — | — | 0.2 | 1.2 | 0 | 0 |
| 57 | 0.5 | 0.5 | 1.0 | 0.1 | — | 0.05 | — | — | — | 0.05 | — | 0.2 | 1.2 | 0.02 | 0.004 |
| 58 | 0.5 | 0.5 | 1.0 | 0.1 | — | 0.05 | — | — | — | — | 0.01 | 0.16 | 1.16 | 0.02 | 0.004 |
| 59 | 0.5 | 0.5 | 1.0 | 0.1 | — | — | — | 0.05 | 0.05 | — | — | 0.2 | 1.2 | 0 | 0 |
| 60 | 0.5 | 0.5 | 1.0 | 0.1 | — | — | — | 0.05 | — | 0.05 | — | 0.2 | 1.2 | 0.02 | 0.004 |
| 61 | 0.5 | 0.5 | 1.0 | 0.1 | — | — | — | 0.05 | — | — | 0.01 | 0.16 | 1.16 | 0.02 | 0 |
| 62 | 0.5 | 0.5 | 1.0 | 0.1 | — | — | — | — | 0.05 | 0.05 | — | 0.2 | 1.2 | 0.01 | 0.002 |
| 63 | 0.5 | 0.5 | 1.0 | 0.1 | — | — | — | — | 0.05 | — | 0.01 | 0.16 | 1.16 | 0 | 0 |
| 64 | 0.5 | 0.5 | 1.0 | 0.1 | 0.05 | 0.05 | 0.05 | — | — | — | — | 0.25 | 1.25 | 0.02 | 0.004 |
| 65 | 0.5 | 0.5 | 1.0 | 0.1 | 0.05 | 0.05 | — | 0.05 | — | — | — | 0.25 | 1.25 | 0.02 | 0.004 |
| 66 | 0.5 | 0.5 | 1.0 | 0.1 | 0.05 | 0.05 | — | — | 0.05 | — | — | 0.25 | 1.25 | 0.01 | 0.002 |
| 67 | 0.5 | 0.5 | 1.0 | 0.1 | 0.05 | 0.05 | — | — | — | — | 0.02 | 0.22 | 1.22 | 0.02 | 0.005 |
| 68 | 0.5 | 0.5 | 1.0 | 0.25 | 0.01 | — | — | — | — | — | — | 0.26 | 1.26 | 0.02 | 0.005 |
| 69 | 1 | 1.3 | 0.8 | 0.1 | — | — | — | — | — | — | — | 0.1 | 2.4 | 0.03 | 0.015 |
| 70 | 1.5 | 0.5 | 3.0 | 0.1 | 0.05 | — | — | — | — | — | — | 0.15 | 2.15 | 0.03 | 0.015 |
| 71 | 0.4 | 0.7 | 0.6 | 0.1 | — | — | — | 0.01 | — | — | — | 0.105 | 1.205 | 0.01 | 0.005 |
| 72 | 0.5 | 0.5 | 1.0 | 0.1 | — | — | — | — | — | — | — | 0.1 | 1.1 | 0.05 | 0.005 |
| 73 | 0.5 | 0.5 | 1.0 | 0.1 | — | — | — | 0.05 | — | — | — | 0.15 | 1.15 | 0.01 | 0.002 |
| 74 | 0.5 | 0.5 | 1.0 | 0.1 | — | — | — | 0.05 | — | — | — | 0.15 | 1.15 | 0.01 | 0.002 |
| 75 | 0.5 | 0.5 | 1.0 | 0.1 | — | — | — | 0.05 | — | — | — | 0.15 | 1.15 | 0.01 | 0.002 |
| 76 | 0.5 | 0.5 | 1.0 | 0.1 | — | — | — | 0.05 | — | — | — | 0.15 | 1.15 | 0.01 | 0.002 |
| 77 | 0.5 | 0.5 | 1.0 | 0.1 | — | — | — | 0.05 | — | — | — | 0.15 | 1.15 | 0.01 | 0.002 |

TABLE 4

| Sample | Alloy Composition [Mass %] | | | | | | | | | | | | | | |
|---|---|---|---|---|---|---|---|---|---|---|---|---|---|---|---|
| | | | | α | | | | | | | | | | | |
| No. | Mg | Si | Mg/Si | Fe | Cu | Mn | Ni | Zr | Cr | Zn | Ga | Total | Total | Ti | B |
| 101 | 2 | 0.1 | 20.0 | — | — | — | — | — | — | — | — | 0 | 2.1 | 0.02 | 0.004 |
| 102 | 0.2 | 2 | 0.1 | — | — | — | — | — | — | — | — | 0 | 2.2 | 0.02 | 0.004 |
| 103 | 2.5 | 3 | 0.8 | — | — | — | — | — | — | — | — | 0 | 5.5 | 0.02 | 0.004 |
| 104 | 0.5 | 0.5 | 1.0 | 0.3 | — | 0.5 | — | 0.5 | — | — | — | 1.3 | 2.3 | 0.02 | 0.004 |
| 105 | 0.5 | 0.5 | 1.0 | — | — | — | — | — | 1 | — | — | 1 | 2 | 0.03 | 0.015 |
| 106 | 0.5 | 0.5 | 1.0 | 0.25 | 0.5 | — | — | — | 0.5 | — | — | 1.25 | 2.25 | 0.01 | 0.002 |
| 111 | 0.5 | 0.5 | 1.0 | 0.1 | — | — | — | — | — | — | — | 0.1 | 1.1 | 0.05 | 0.005 |
| 112 | 0.5 | 0.5 | 1.0 | 0.1 | — | — | — | — | — | — | — | 0.1 | 1.1 | 0.05 | 0.005 |
| 113 | 0.5 | 0.5 | 1.0 | 0.1 | — | — | — | — | — | — | — | 0.1 | 1.1 | 0.05 | 0.005 |
| 114 | 0.5 | 0.5 | 1.0 | 0.1 | — | — | — | — | — | — | — | 0.1 | 1.1 | 0.05 | 0.005 |
| 115 | 0.5 | 0.5 | 1.0 | 0.1 | — | — | — | — | — | — | — | 0.1 | 1.1 | 0.05 | 0.005 |
| 116 | 0.5 | 0.5 | 1.0 | 0.1 | — | — | — | — | — | — | — | 0.1 | 1.1 | 0.05 | 0.005 |
| 117 | 0.5 | 0.5 | 1.0 | 0.1 | — | — | — | — | — | — | — | 0.1 | 1.1 | 0.05 | 0.005 |
| 118 | 0.67 | 0.52 | 1.3 | 0.13 | — | — | — | 0.05 | — | — | — | 0.18 | 1.37 | 0.02 | 0.004 |
| 119 | 0.4 | 0.7 | 0.6 | 0.1 | — | — | — | 0.01 | — | — | — | 0.105 | 1.205 | 0.01 | 0.005 |

TABLE 5

| | Manufacturing Condition | | | | | |
|---|---|---|---|---|---|---|
| | | Casting Condition | | Aging Condition | | |
| Sample No. | Casting | Temperature of Melt [° C.] | Cooling Rate [° C./sec] | Temperature [° C.] | Time [H] | Atmosphere |
| 1 | Continuous | 740 | 6 | 130 | 17 | Atmospheric Air |
| 2 | Billet | 690 | 2 | 120 | 18 | Atmospheric Air |
| 3 | Continuous | 700 | 3 | 160 | 10 | Nitrogen Gas |
| 4 | Continuous | 740 | 20 | 140 | 16 | Reducing Gas |
| 5 | Continuous | 700 | 6 | 130 | 17 | Atmospheric Air |
| 6 | Continuous | 700 | 2 | 180 | 8 | Atmospheric Air |
| 7 | Continuous | 730 | 2 | 210 | 8 | Atmospheric Air |
| 8 | Continuous | 745 | 4 | 160 | 12 | Reducing Gas |
| 9 | Continuous | 745 | 6 | 160 | 8 | Reducing Gas |
| 10 | Continuous | 730 | 1 | 220 | 6 | Atmospheric Air |
| 11 | Continuous | 730 | 2 | 140 | 16 | Reducing Gas |
| 12 | Continuous | 700 | 2 | 160 | 14 | Reducing Gas |
| 13 | Billet | 690 | 38 | 150 | 14 | Reducing Gas |
| 14 | Continuous | 670 | 2 | 160 | 15 | Atmospheric Air |
| 15 | Continuous | 745 | 22 | 180 | 20 | Reducing Gas |
| 16 | Continuous | 700 | 2 | 120 | 19 | Reducing Gas |
| 17 | Continuous | 710 | 7 | 220 | 7 | Atmospheric Air |
| 18 | Billet | 710 | 4 | 120 | 18 | Reducing Gas |

TABLE 6

| | Manufacturing Condition | | | | | |
|---|---|---|---|---|---|---|
| | | Casting Condition | | Aging Condition | | |
| Sample No. | Casting | Temperature of Melt [° C.] | Cooling Rate [° C./sec] | Temperature [° C.] | Time [H] | Atmosphere |
| 19 | Billet | 670 | 9 | 120 | 19 | Atmospheric Air |
| 20 | Billet | 670 | 3 | 140 | 16 | Reducing Gas |
| 21 | Continuous | 740 | 6 | 220 | 5 | Atmospheric Air |
| 22 | Continuous | 710 | 2 | 160 | 10 | Reducing Gas |
| 23 | Continuous | 670 | 3 | 130 | 18 | Nitrogen Gas |
| 24 | Continuous | 670 | 2 | 180 | 11 | Reducing Gas |
| 25 | Continuous | 710 | 2 | 140 | 16 | Nitrogen Gas |
| 26 | Continuous | 690 | 2 | 160 | 14 | Reducing Gas |
| 27 | Continuous | 710 | 8 | 160 | 13 | Nitrogen Gas |
| 28 | Continuous | 720 | 24 | 120 | 18 | Reducing Gas |
| 29 | Continuous | 730 | 6 | 220 | 6 | Atmospheric Air |
| 30 | Continuous | 690 | 4 | 240 | 4 | Atmospheric Air |
| 31 | Billet | 700 | 1 | 140 | 16 | Nitrogen Gas |
| 32 | Continuous | 670 | 19 | 150 | 13 | Reducing Gas |
| 33 | Continuous | 740 | 2 | 140 | 16 | Reducing Gas |
| 34 | Continuous | 680 | 2 | 200 | 5 | Reducing Gas |
| 35 | Continuous | 670 | 4 | 160 | 10 | Reducing Gas |
| 36 | Continuous | 700 | 3 | 220 | 8 | Atmospheric Air |
| 37 | Continuous | 680 | 4 | 140 | 16 | Reducing Gas |
| 38 | Continuous | 670 | 3 | 120 | 16 | Reducing Gas |
| 39 | Continuous | 710 | 2 | 200 | 9 | Reducing Gas |
| 40 | Continuous | 720 | 2 | 220 | 7 | Nitrogen Gas |
| 41 | Billet | 680 | 5 | 180 | 10 | Atmospheric Air |
| 42 | Continuous | 710 | 2 | 160 | 14 | Reducing Gas |
| 43 | Continuous | 680 | 10 | 160 | 10 | Reducing Gas |
| 44 | Continuous | 710 | 4 | 220 | 6 | Atmospheric Air |
| 45 | Continuous | 700 | 2 | 230 | 5 | Atmospheric Air |
| 46 | Continuous | 740 | 2 | 120 | 20 | Reducing Gas |
| 47 | Continuous | 680 | 10 | 160 | 8 | Reducing Gas |

TABLE 7

| Sample No. | Manufacturing Condition | | | | | |
|---|---|---|---|---|---|---|
| | | Casting Condition | | Aging Condition | | |
| | Casting | Temperature of Melt [° C.] | Cooling Rate [° C./sec] | Temperature [° C.] | Time [H] | Atmosphere |
| 48 | Billet | 700 | 2 | 160 | 12 | Reducing Gas |
| 49 | Continuous | 680 | 2 | 140 | 16 | Reducing Gas |
| 50 | Billet | 720 | 5 | 120 | 18 | Reducing Gas |
| 51 | Continuous | 690 | 2 | 200 | 10 | Atmospheric Air |
| 52 | Continuous | 740 | 2 | 160 | 14 | Reducing Gas |
| 53 | Continuous | 690 | 2 | 130 | 16 | Nitrogen Gas |
| 54 | Billet | 670 | 2 | 160 | 11 | Reducing Gas |
| 55 | Billet | 730 | 2 | 160 | 14 | Reducing Gas |
| 56 | Continuous | 680 | 4 | 120 | 18 | Atmospheric Air |
| 57 | Continuous | 680 | 4 | 180 | 13 | Reducing Gas |
| 58 | Continuous | 690 | 3 | 160 | 15 | Reducing Gas |
| 59 | Continuous | 745 | 10 | 150 | 15 | Nitrogen Gas |
| 60 | Continuous | 720 | 4 | 180 | 12 | Reducing Gas |
| 61 | Continuous | 700 | 4 | 140 | 16 | Nitrogen Gas |
| 62 | Continuous | 720 | 9 | 220 | 4 | Atmospheric Air |
| 63 | Continuous | 720 | 2 | 140 | 16 | Nitrogen Gas |
| 64 | Continuous | 720 | 2 | 180 | 11 | Nitrogen Gas |
| 65 | Continuous | 720 | 2 | 160 | 16 | Reducing Gas |
| 66 | Continuous | 710 | 3 | 180 | 10 | Reducing Gas |
| 67 | Continuous | 690 | 2 | 140 | 16 | Nitrogen Gas |
| 68 | Continuous | 680 | 4 | 180 | 9 | Reducing Gas |
| 69 | Continuous | 680 | 22 | 120 | 17 | Reducing Gas |
| 70 | Continuous | 720 | 10 | 150 | 14 | Nitrogen Gas |
| 71 | Continuous | 745 | 10 | 150 | 5 | Reducing Gas |
| 72 | Continuous | 680 | 10 | 160 | 10 | Reducing Gas |
| 73 | Continuous | 690 | 10 | 160 | 10 | Reducing Gas |
| 74 | Continuous | 680 | 15 | 160 | 10 | Reducing Gas |
| 75 | Continuous | 670 | 10 | 160 | 10 | Reducing Gas |
| 76 | Continuous | 680 | 10 | 160 | 10 | Reducing Gas |
| 77 | Continuous | 690 | 7 | 160 | 10 | Reducing Gas |

TABLE 8

| Sample No. | Manufacturing Condition | | | | | |
|---|---|---|---|---|---|---|
| | | Casting Condition | | Aging Condition | | |
| | Casting | Temperature of Melt [° C.] | Cooling Rate [° C./sec] | Temperature [° C.] | Time [H] | Atmosphere |
| 101 | Continuous | 700 | 2 | 140 | 16 | Nitrogen Gas |
| 102 | Continuous | 700 | 2 | 140 | 16 | Nitrogen Gas |
| 103 | Continuous | 740 | 2 | 140 | 16 | Nitrogen Gas |
| 104 | Continuous | 690 | 5 | 140 | 16 | Nitrogen Gas |
| 105 | Continuous | 720 | 2 | 140 | 16 | Nitrogen Gas |
| 106 | Continuous | 690 | 2 | 140 | 16 | Nitrogen Gas |
| 111 | Continuous | 820 | 2 | 140 | 16 | Reducing Gas |
| 112 | Continuous | 730 | 0.5 | 140 | 16 | Reducing Gas |
| 113 | Continuous | 740 | 2 | 300 | 50 | Reducing Gas |
| 114 | Continuous | 720 | 2 | 140 | 16 | Reducing Gas |
| 115 | Continuous | 670 | 2 | 140 | 16 | Reducing Gas |
| 116 | Continuous | 690 | 2 | 140 | 16 | * |
| 117 | Continuous | 700 | 2 | 140 | 16 | Reducing Gas |
| 118 | Continuous | 820 | 2 | 160 | 8 | Reducing Gas |
| 119 | Continuous | 750 | 25 | 150 | 5 | Reducing Gas |

(Mechanical Characteristic and Electrical Characteristic)

For each of the obtained aged members each having a wire diameter ϕ of 0.3 mm, a tensile strength (MPa), a 0.2% proof stress (MPa), a breaking elongation (%), a work hardening exponent, and an electrical conductivity (% IACS) were measured. Moreover, a ratio "Proof Stress/Tensile" of the 0.2% proof stress to the tensile strength was found. Results are shown in Table 9 to Table 12.

The tensile strength (MPa), 0.2% proof stress (MPa), and breaking elongation (%) were measured using a general-purpose tension tester in accordance with JIS Z 2241 (Metallic Materials-Tensile Testing-Method, 1998). The work hardening exponent is defined as an exponent n of a true strain ε in $\sigma=C\times\varepsilon^{n}$, which is a formula of true stress 6 and true strain E in a plastic strain region under application of a test force in an uniaxial direction in the tensile test. In the formula, C represents a strength constant. Exponent n is determined by performing a tensile test using the tension tester and creating a S-S curve (see also JIS G 2253, 2011). The electrical conductivity (% IACS) was measured in accordance with a bridge method.

(Fatigue Characteristic)

For each of the obtained aged members each having a wire diameter ϕ of 0.3 mm, a bending test was performed to measure the number of times of bending until breakage occurred. The bending test was performed using a commercially available repeated-bending tester. Here, repeated bending is applied to each wire member of the samples under application of a load of 12.2 MPa using a jig capable of applying a bending distortion of 0.3%. For each sample, three or more wires are subjected to the bending test and the average thereof (the number of times of bending) is shown in Table 9 to Table 12. As the number of times of bending until occurrence of breakage is larger, it can be said that breakage is less likely to occur due to the repeated bending and the fatigue characteristic is excellent.

TABLE 9

| | ϕ0.3 mm | | | | | | |
|---|---|---|---|---|---|---|---|
| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
| 1 | 0.59 | 152 | 90 | 60 | 30 | 17063 | 0.26 |
| 2 | 0.66 | 150 | 98 | 61 | 29 | 16542 | 0.19 |
| 3 | 0.71 | 189 | 134 | 54 | 24 | 22804 | 0.17 |
| 4 | 0.78 | 206 | 161 | 54 | 24 | 23616 | 0.17 |
| 5 | 0.68 | 212 | 144 | 53 | 24 | 23758 | 0.17 |
| 6 | 0.75 | 228 | 171 | 52 | 21 | 27860 | 0.15 |
| 7 | 0.68 | 251 | 171 | 51 | 17 | 30661 | 0.13 |
| 8 | 0.67 | 259 | 173 | 51 | 14 | 28803 | 0.12 |
| 9 | 0.67 | 294 | 197 | 54 | 9 | 32731 | 0.09 |
| 10 | 0.67 | 247 | 166 | 50 | 13 | 28607 | 0.11 |
| 11 | 0.70 | 263 | 185 | 51 | 11 | 30379 | 0.10 |
| 12 | 0.66 | 247 | 163 | 50 | 17 | 30159 | 0.13 |
| 13 | 0.70 | 291 | 203 | 49 | 10 | 34041 | 0.10 |
| 14 | 0.71 | 294 | 209 | 47 | 10 | 35684 | 0.10 |
| 15 | 0.71 | 315 | 224 | 48 | 13 | 35361 | 0.12 |
| 16 | 0.71 | 306 | 218 | 47 | 8 | 36595 | 0.09 |
| 17 | 0.70 | 348 | 243 | 43 | 6 | 40600 | 0.08 |
| 18 | 0.67 | 341 | 230 | 43 | 7 | 40256 | 0.08 |

TABLE 10

| | ϕ0.3 mm | | | | | | |
|---|---|---|---|---|---|---|---|
| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
| 19 | 0.70 | 235 | 164 | 52 | 21 | 26756 | 0.15 |
| 20 | 0.69 | 242 | 168 | 51 | 22 | 29421 | 0.16 |
| 21 | 0.67 | 246 | 164 | 49 | 19 | 28638 | 0.15 |
| 22 | 0.67 | 245 | 163 | 51 | 18 | 28025 | 0.14 |
| 23 | 0.67 | 240 | 162 | 51 | 17 | 27072 | 0.14 |
| 24 | 0.69 | 277 | 190 | 48 | 7 | 32533 | 0.09 |
| 25 | 0.73 | 240 | 176 | 52 | 20 | 29346 | 0.15 |
| 26 | 0.70 | 312 | 219 | 40 | 7 | 35966 | 0.08 |
| 27 | 0.69 | 242 | 168 | 51 | 23 | 28898 | 0.16 |
| 28 | 0.71 | 270 | 191 | 47 | 24 | 29844 | 0.17 |
| 29 | 0.71 | 240 | 170 | 51 | 19 | 27276 | 0.14 |
| 30 | 0.71 | 250 | 176 | 48 | 5 | 29672 | 0.07 |
| 31 | 0.67 | 242 | 163 | 52 | 20 | 28170 | 0.15 |
| 32 | 0.67 | 272 | 182 | 43 | 16 | 30109 | 0.13 |
| 33 | 0.67 | 235 | 157 | 52 | 21 | 27585 | 0.15 |
| 34 | 0.67 | 241 | 161 | 46 | 14 | 26831 | 0.12 |
| 35 | 0.70 | 250 | 175 | 50 | 19 | 29452 | 0.14 |
| 36 | 0.73 | 277 | 204 | 46 | 13 | 31435 | 0.11 |
| 37 | 0.68 | 235 | 159 | 52 | 21 | 25898 | 0.15 |
| 38 | 0.68 | 267 | 180 | 49 | 17 | 32427 | 0.13 |
| 39 | 0.74 | 248 | 185 | 50 | 18 | 28201 | 0.14 |
| 40 | 0.71 | 256 | 181 | 50 | 20 | 31000 | 0.15 |
| 41 | 0.73 | 308 | 225 | 44 | 18 | 33949 | 0.14 |
| 42 | 0.72 | 249 | 179 | 50 | 21 | 28235 | 0.15 |
| 43 | 0.72 | 253 | 182 | 50 | 16 | 29335 | 0.13 |
| 44 | 0.67 | 315 | 210 | 45 | 18 | 34729 | 0.14 |

TABLE 10-continued

| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
|---|---|---|---|---|---|---|---|
| | ϕ0.3 mm | | | | | | |
| 45 | 0.69 | 248 | 170 | 49 | 19 | 29097 | 0.14 |
| 46 | 0.69 | 240 | 166 | 51 | 22 | 27787 | 0.16 |
| 47 | 0.72 | 253 | 182 | 52 | 16 | 29335 | 0.13 |

TABLE 11

| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
|---|---|---|---|---|---|---|---|
| | ϕ0.3 mm | | | | | | |
| 48 | 0.71 | 324 | 231 | 48 | 13 | 36102 | 0.11 |
| 49 | 0.67 | 253 | 169 | 51 | 20 | 27970 | 0.15 |
| 50 | 0.72 | 247 | 178 | 51 | 16 | 28369 | 0.13 |
| 51 | 0.71 | 249 | 176 | 51 | 21 | 27524 | 0.15 |
| 52 | 0.70 | 248 | 173 | 51 | 21 | 28955 | 0.15 |
| 53 | 0.69 | 248 | 171 | 51 | 22 | 28938 | 0.16 |
| 54 | 0.67 | 317 | 211 | 43 | 17 | 35884 | 0.13 |
| 55 | 0.76 | 301 | 229 | 45 | 8 | 33716 | 0.09 |
| 56 | 0.71 | 351 | 251 | 43 | 10 | 39315 | 0.10 |
| 57 | 0.72 | 300 | 216 | 45 | 18 | 33562 | 0.14 |
| 58 | 0.73 | 297 | 218 | 46 | 20 | 36172 | 0.15 |
| 59 | 0.71 | 281 | 199 | 50 | 15 | 33010 | 0.12 |
| 60 | 0.73 | 246 | 180 | 50 | 18 | 27698 | 0.14 |
| 61 | 0.70 | 244 | 172 | 51 | 18 | 29624 | 0.14 |
| 62 | 0.71 | 306 | 217 | 44 | 18 | 35731 | 0.14 |
| 63 | 0.72 | 308 | 223 | 46 | 21 | 36990 | 0.15 |
| 64 | 0.70 | 328 | 228 | 49 | 14 | 38527 | 0.12 |
| 65 | 0.72 | 316 | 227 | 49 | 12 | 34800 | 0.11 |
| 66 | 0.68 | 376 | 256 | 47 | 5 | 44420 | 0.05 |
| 67 | 0.73 | 321 | 235 | 49 | 14 | 39167 | 0.12 |
| 58 | 0.69 | 258 | 177 | 50 | 16 | 28786 | 0.13 |
| 69 | 0.71 | 360 | 256 | 45 | 9 | 40393 | 0.10 |
| 70 | 0.71 | 357 | 252 | 46 | 8 | 41929 | 0.09 |
| 71 | 0.71 | 265 | 187 | 50 | 18 | 31356 | 0.10 |
| 72 | 0.73 | 249 | 181 | 51 | 14 | 26923 | 0.12 |
| 73 | 0.73 | 250 | 182 | 50 | 15 | 28987 | 0.12 |
| 74 | 0.72 | 241 | 174 | 51 | 12 | 27943 | 0.11 |
| 75 | 0.72 | 257 | 185 | 50 | 16 | 29798 | 0.13 |
| 76 | 0.72 | 245 | 177 | 51 | 13 | 28407 | 0.11 |
| 77 | 0.72 | 224 | 162 | 49 | 18 | 30381 | 0.14 |

TABLE 12

| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
|---|---|---|---|---|---|---|---|
| | ϕ0.3 mm | | | | | | |
| 101 | 0.87 | 264 | 231 | 40 | 4 | 30567 | 0.04 |
| 102 | 0.71 | 229 | 162 | 39 | 4 | 25467 | 0.04 |
| 103 | 0.67 | 383 | 256 | 37 | 3 | 42276 | 0.03 |
| 104 | 0.67 | 313 | 209 | 44 | 3 | 35937 | 0.03 |
| 105 | 0.68 | 320 | 219 | 46 | 4 | 35443 | 0.04 |
| 106 | 0.69 | 268 | 185 | 46 | 4 | 31291 | 0.04 |
| 111 | 0.70 | 237 | 166 | 51 | 17 | 19543 | 0.12 |
| 112 | 0.70 | 236 | 165 | 51 | 14 | 25954 | 0.09 |
| 113 | 0.68 | 125 | 85 | 60 | 52 | 14758 | 0.28 |
| 114 | 0.69 | 243 | 167 | 51 | 22 | 21658 | 0.13 |
| 115 | 0.70 | 241 | 169 | 51 | 21 | 19899 | 0.12 |

TABLE 12-continued

| | ϕ0.3 mm | | | | | | |
|---|---|---|---|---|---|---|---|
| Sample No. | Proof Stress/ Tensile | Tensile Strength [MPa] | 0.2% Proof Stress [MPa] | Electrical Conductivity [% IACS] | Breakage Elongation [%] | Bending [Number of Times] | Work Hardening Exponent |
| 116 | 0.70 | 242 | 170 | 51 | 21 | 27198 | 0.12 |
| 117 | 0.70 | 241 | 169 | 51 | 22 | 28339 | 0.13 |
| 118 | 0.72 | 245 | 177 | 52 | 12 | 28407 | 0.11 |
| 119 | 0.71 | 256 | 182 | 50 | 16 | 29465 | 0.08 |

Each of the obtained wire-drawn members each having a wire diameter ϕ of 0.25 mm or a wire diameter ϕ of 0.32 mm (wire-drawn members each not having been through the aging treatment and the solution treatment just before the aging; in the case of manufacturing methods B, F, and G, wire-drawn members each not having been through the aging treatment) is used to produce a strand wire. For the stranding, a commercially available lubricant (oil including carbon) is used appropriately. Here, a strand wire is produced using seven wire members each having a wire diameter ϕ of 0.25 mm. Moreover, a compressed strand wire is produced by further compressing a strand wire using seven wire members each having a wire diameter ϕ of 0.32 mm. Each of the cross-sectional area of the strand wire and the cross-sectional area of the compressed strand wire is 0.35 $mm^2$ (0.35 sq). The strand pitch is 20 mm (which is about 40 times as large as the pitch diameter in the case where the wire-drawn member having a wire diameter ϕ of 0.25 mm is used, and is about 32 times as large as the pitch diameter in the case where the wire-drawn member having a wire diameter ϕ of 0.32 mm is used).

Each of the obtained strand wires or compressed strand wires is subjected to the solution treatment and the aging treatment in this order (in the case of manufacturing methods B, F, and G, only the aging treatment is performed). The heat treatment conditions in each case are the same as those for the wire-drawn members each having a wire diameter of 0.3 mm. The solution treatment is a high-frequency induction-heating type continuous process, and the aging treatment is a batch process performed under the conditions shown in Table 5 to Table 8 (see the description above for * of sample No. 116). Each of the obtained aged strand wires is employed as a conductor to form an insulation cover (having a thickness of 0.2 mm) on the outer circumference of the conductor using an insulating material (here, a halogen-free insulating material), thereby producing a covered electrical wire. At least one of the amount of use of the lubricant during the wire drawing and the amount of use of the lubricant during the stranding is adjusted such that a certain amount of the lubricant remains after the aging treatment. For a sample No. 29, a larger amount of the lubricant is used than those of the other samples. For a sample No. 117, the amount of use of the lubricant is the largest. For a sample No. 114, a degreasing treatment is performed after the aging treatment. For a sample No. 113, the aging is performed at a higher temperature and a longer time than those of the other samples, i.e., at an aging temperature of 300° C. for a holding time of 50 hours.

Below-described matters were examined for each of the obtained covered electrical wires of the samples or terminal-equipped electrical wires obtained by attaching crimp terminals to the covered electrical wires. The below-described matters were examined with regard to a case where the conductor of the covered electrical wire was constituted of the strand wire and a case where the conductor of the covered electrical wire was constituted of the compressed strand wire. Each of Table 13 to Table 20 shows results in the case where the conductor is constituted of the strand wire; however, it has been confirmed that there is no large difference between the result in the case where the conductor is constituted of the strand wire and the result in the case where the conductor is constituted of the compressed strand wire.

(Surface Property)

Dynamic Friction Coefficient

From each of the obtained covered electrical wires of the samples, the insulation cover was removed and the conductor solely existed. Then, the strand wire or compressed strand wire constituting the conductor was unbound into elemental wires. Each of the elemental wires (Al alloy wires) was employed as a sample to measure a dynamic friction coefficient in a below-described manner. Results are shown in Table 17 to Table 20. As shown in FIG. 5, a mount 100 in a shape of a rectangular parallelepiped is prepared. An elemental wire (Al alloy wire) serving as a counterpart material 150 is laid on one rectangular surface of the surfaces of mount 100 in parallel with the short side direction of the rectangular surface. Both ends of counterpart material 150 are fixed (positions of fixation are not shown). An elemental wire (Al alloy wire) serving as a sample S is disposed horizontally on counterpart material 150 so as to be orthogonal to counterpart material 150 and in parallel with the long side direction of the above-described one surface of mount 100. A weight 110 having a predetermined mass (here, 200 g) is disposed on a crossing position between sample S and counterpart material 150 so as to avoid deviation of the crossing position. In this state, a pulley is disposed in the middle of sample S and one end of sample S is pulled upward along the pulley to measure tensile force (N) using an autograph or the like. An average load during a period of time from the start of a relative deviation movement between sample S and counterpart material 150 to a moment at which they are moved by 100 mm is defined as dynamical friction force (N). A value (dynamical friction force/normal force) obtained by dividing the dynamical friction force by normal force (here, 2 N) generated by the mass of weight 110 is employed as a dynamic friction coefficient.

Surface Roughness

From each of the obtained covered electrical wires of the samples, the insulation cover was removed and the conductor solely existed. Then, the strand wire or compressed strand wire constituting the conductor was unbound into elemental wires. Each of the elemental wires (Al alloy wires) was employed as a sample to measure a surface roughness (μm) using a commercially available three-dimensional optical profiler (for example, NewView7100 provided by ZYGO). Here, in each elemental wire (Al alloy wire), an arithmetic mean roughness Ra (μm) is determined within a rectangular region of 85 μm×64 μm. For each sample, arithmetic mean roughnesses Ra in a total of seven regions are found and an average value of arithmetic mean roughnesses Ra in the total of seven regions is employed as a surface roughness (μm), which is shown in Table 17 to Table 20.

Amount of Adhesion of C

From each of the obtained covered electrical wires of the samples, the insulation cover was removed and the conductor solely existed. Then, the strand wire or compressed strand wire constituting the conductor was unbound so as to find the amount of adhesion of C originated from the lubricant adhered to a surface of the central elemental wire. The amount of adhesion (mass %) of C was measured using a SEM-EDX (energy dispersive X-ray analysis) device with an acceleration voltage of an electron gun being set to 5 kV. Results are shown in Table 13 to Table 16. It should be noted that in the case where the lubricant is adhered to the surface of the Al alloy wire constituting the conductor included in the covered electrical wire, the lubricant may be removed together with the insulation cover at a contact position with the insulation cover in the Al alloy wire when removing the insulation cover, with the result that the amount of adhesion of C may be unable to be measured appropriately. On the other hand, in the case where the amount of adhesion of C on the surface of the Al alloy wire constituting the conductor included in the covered electrical wire is measured, it is considered that the amount of adhesion of C can be precisely measured by measuring the amount of adhesion of C at a position of the Al alloy wire not in contact with the insulation cover. Hence, here, in the strand wire or compressed strand wire each including seven Al alloy wires stranded together with respect to the same center, the amount of adhesion of C is measured at the central elemental wire that is not in contact with the insulation cover. The amount of adhesion of C may be measured on an outer circumferential elemental wire of the outer circumferential elemental wires, which surround the outer circumference of the central elemental wire, at its portion not in contact with the insulation cover.

Surface Oxide Film

From each of the obtained covered electrical wires of the samples, the insulation cover was removed and the conductor solely existed. Then, the strand wire or compressed strand wire constituting the conductor was unbound so as to measure the surface oxide film of each elemental wire in a below-described manner. Here, the thickness of the surface oxide film of each elemental wire (Al alloy wire) is measured. For each sample, the thicknesses of the surface oxide films in a total of seven elemental wires are found and an average value of the thicknesses of the surface oxide films in the total of seven elemental wires is employed as the thickness (μm) of the surface oxide film, which is shown in Table 17 to Table 20. A cross section polisher (CP) process is performed to obtain a cross section of each elemental wire so as to observe the cross section using a SEM. The thickness of a comparatively thick oxide film of about more than 50 nm is measured using this SEM observation image. In the SEM observation, when a comparatively thin oxide film having a thickness of less than or equal to about 50 nm is included, measurement is performed by additionally performing an analysis (by repeating sputtering and an analysis with energy dispersive X-ray analysis (EDX)) in the depth direction using an X-ray electron spectroscopy for chemical analysis (ESCA).

(Structure Observation)

Voids

For each of the obtained covered electrical wires of the samples, a transverse section is taken to observe the conductor (the strand wire or compressed strand wire constituted of the Al alloy wires; the same applies to the description below) using a scanning electron microscope (SEM), thus measuring voids and crystal grain sizes in the surface layer and inner portion thereof. Here, in each Al alloy wire constituting the conductor, a surface-layer void measurement region in the shape of a rectangle having a short side length of 30 μm and having a long side length of 50 μm is defined within a surface layer region extending from the surface of the Al alloy wire by 30 μm in the depth direction. That is, for one sample, one surface-layer void measurement region is defined in each of the seven Al alloy wires constituting the strand wire, thus defining a total of seven surface-layer void measurement regions. Then, the total cross-sectional area of the voids in each surface-layer void measurement region is determined. For each sample, the total cross-sectional areas of the voids in the total of seven surface-layer void measurement regions are measured. The average value of the total cross-sectional areas of the voids in the total of seven measurement regions is employed as a total area A ($\mu m^2$), which is shown in Table 13 to Table 16.

Instead of the surface-layer void measurement region in the shape of a rectangle, a void measurement region in the shape of a sector having an area of 1500 $\mu m^2$ is defined within an annular surface layer region having a thickness of 30 μm, and a total area B ($\mu m^2$) of the voids in the void measurement regions each in the shape of a sector was determined in the same manner as in the evaluation for the surface-layer void measurement regions each in the shape of a rectangle. Results are shown in Table 13 to Table 16.

It should be noted that the total cross-sectional area of the voids can be measured readily by performing an image process, such as a binarization process, to an observation image and extracting the voids from the processed image. The same applies to the crystallized materials described later.

In the above-described transverse section, an inner void measurement region in the shape of a rectangle having a short side length of 30 μm and a long side length of 50 μm is defined within each Al alloy wire constituting the conductor. The inner void measurement region is defined such that the center of the rectangle of the inner void measurement region coincides with the center of the Al alloy wire. A ratio "Inner Portion/Surface Layer" of a total cross-sectional area of voids in the inner void measurement region to the total cross-sectional area of the voids in the surface-layer void measurement region is determined. For each sample, a total of seven surface-layer void measurement regions and a total of seven inner void measurement regions are defined so as to determine respective ratios "Inner Portion/Surface Layer". The average value of the ratios "Inner Portion/Surface Layer" of the total of the seven measurement regions is employed as a ratio "Inner Portion/Surface Layer A", which is shown in Table 13 to Table 16. A ratio "Inner Portion/Surface Layer B" in the case where the void measurement regions each in the shape of a sector is employed is determined in the same manner as the evaluation for the surface-layer void measurement regions each in the shape of a rectangle. Results are shown in Table 13 to Table 16.

Crystal Grain Size

Moreover, in the above-described transverse section, a test line is drawn on the SEM observation image in accordance with JIS G 0551 (Steels-Micrographic Determination of Apparent Grain Size, 2013). A length of each crystal grain dividing the test line is regarded as the crystal grain size (intercept method). The length of the test line is such a length that more than or equal to ten crystal grains are divided by this test line. Three test lines are drawn on one transverse section to determine each crystal grain size. The average value of these crystal grain sizes is employed as an average crystal grain size (μm), which is shown in Table 13 to Table 16.

Crystallized Materials

For each of the obtained covered electrical wires of the samples, a transverse section is taken to observe the conductor using a metaloscope so as to examine the crystallized materials in the surface layer and inner portion thereof. Here, in each Al alloy wire constituting the conductor, a surface-layer crystallization measurement region in the shape of a rectangle having a short side length of 50 μm and having a long side length of 75 μm is defined within a surface layer region extending from the surface of the Al alloy wire by 50 μm in the depth direction. That is, for one sample, one surface-layer crystallization measurement region is defined in each of the seven Al alloy wires constituting the strand wire, thus defining a total of seven surface-layer crystallization measurement regions. Then, the areas and the number of the crystallized materials in each surface-layer crystallization measurement region are determined. For each surface-layer crystallization measurement region, the average of the areas of the crystallized materials is determined. That is, for one sample, the averages of the areas of the crystallized materials in the total of seven measurement regions are determined. For each sample, an average value of the averages of the areas of the crystallized materials in the total of seven measurement regions is employed as an average area A ($\mu m^2$), which is shown in Table 13 to Table 16.

Moreover, for each sample, the numbers of the crystallized materials in the total of seven surface-layer crystallization measurement regions are determined, and an average value of the numbers of the crystallized materials in the total of seven measurement regions is determined as a number A (number of pieces), which is shown in Table 13 to Table 16.

Further, the total area of crystallized materials each existing in each surface-layer crystallization measurement region and each having an area of less than or equal to 3 $\mu m^2$ is determined. Then, a ratio of the total area of the crystallized materials each having an area of less than or equal to 3 $\mu m^2$ to the total area of all the crystallized materials in each surface-layer crystallization measurement region is determined. For each sample, the ratios of the total areas in the total of seven surface-layer crystallization measurement regions are determined. The average value of the ratios of the total areas in the total of seven measurement regions is employed as an area ratio A (%), which is shown in Table 13 to Table 16.

Instead of the surface-layer crystallization measurement region in the shape of a rectangle, a crystallization measurement region in the shape of a sector having an area of 3750 $\mu m^2$ is defined within an annular surface layer region having a thickness of 50 μm, and an average area B ($\mu m^2$) of the crystallized materials in the crystallization measurement region in the shape of a sector was determined in the same manner as in the evaluation for the surface-layer crystallization measurement region in the shape of a rectangle. Moreover, the number B of the crystallized materials (the number of pieces) in the crystallization measurement region in the shape of a sector and an area ratio B (%) of the total area of the crystallized materials each having an area of less than or equal to 3 $\mu m^2$ were determined in the same manner as in the evaluation for the surface-layer crystallization measurement region in the shape of a rectangle. Results are shown in Table 13 to Table 16.

In the above-described transverse section, an inner crystallization measurement region in the shape of a rectangle having a short side length of 50 μm and a long side length of 75 μm is defined within each Al alloy wire constituting the conductor. This inner crystallization measurement region is defined such that the center of the rectangle of the inner crystallization measurement region coincides with the center of the Al alloy wire. Then, the average of the areas of the crystallized materials in the inner crystallization measurement regions is determined. For each sample, the averages of the areas of the crystallized materials in a total of seven inner crystallization measurement regions are determined. The average value of the averages of the above-described areas in the total of seven measurement regions is employed as the average area (Inner Portion). The average areas (Inner Portion) of samples No. 20, No. 40, and No. 70 were 2 $\mu m^2$, 3 $\mu m^2$, and 1 $\mu m^2$, respectively. Each of the average areas (Inner Portion) of the samples other than the above three samples among samples No. 1 to No. 77 was more than or equal to 0.05 $\mu m^2$ and less than or equal to 40 $\mu m^2$. In many cases, each of the average areas was more than or equal to 35 $\mu m^2$.

(Hydrogen Content)

For each of the obtained covered electrical wires of the samples, the insulation cover was removed and the conductor solely existed. The content (m1/100 g) of hydrogen per 100 g of the conductor was measured. Results are shown in Table 13 to Table 16. The content of hydrogen is measured in accordance with an inert gas melting method. Specifically, the sample is introduced into a graphite crucible in an argon gas flow and is heated and melted to extract hydrogen together with other gases. The extracted gases are caused to pass through a separation column to separate hydrogen from the other gases. Measurement is performed using a thermal conductivity detector and the concentration of hydrogen is quantified, thereby determining the content of hydrogen.

(Impact Resistance)

For each of the obtained covered electrical wires of the samples, an impact resistance (Jim) was evaluated with reference to PTL 1. As an overview, a weight is attached to a front end of the sample with a distance between evaluation points being 1 m. This weight is raised upward by 1 m, and then is free-fallen so as to measure the maximum mass (kg) of the weight with which the sample is not disconnected. A product value is obtained by multiplying the mass of the weight by gravitational acceleration (9.8 $m/s^2$) and the falling distance of 1 m, and a value obtained by dividing the product value by the falling distance (1 m) is employed as an evaluation parameter for impact resistance (J/m or (N·m)/m). A value obtained by dividing the determined evaluation parameter by the cross-sectional area of the conductor (here, 0.35 $mm^2$) is employed as an evaluation parameter for impact resistance per unit area ($J/m \cdot mm^2$), which is shown in Table 17 to Table 20.

(Terminal Fixing Force)

For each of the obtained terminal-equipped electrical wires of the samples, a terminal fixing force (N) was evaluated with reference to PTL 1. As an overview, the terminal portion attached to one end of the terminal-equipped electrical wire is held by a terminal zipper, the insulation cover is removed from the other end of the covered electrical wire, and a portion of the conductor is held by a conductor zipper. For the terminal-equipped electrical wire of each sample with the respective ends being held by both the zippers, a maximum load (N) upon breakage is measured using a general-purpose tension tester and this maximum load (N) is evaluated as a terminal fixing force (N). A value obtained by dividing the determined maximum load by the cross-sectional area (here, 0.35 $mm^2$) of the conductor is employed as a terminal fixing force per unit area ($N/mm^2$), which is shown in Table 17 to Table 20.

(Corrosion Resistance)

For each of the obtained covered electrical wires of the samples, the insulation cover was removed and the conductor solely existed. The strand wire or compressed strand wire constituting the conductor was unbound into elemental wires, any one of which was employed as a sample for a salt spray test so as to determine whether or not corrosion occurred by way of visual checking. Results are shown in Table 21. The salt spray test is performed under the following conditions: a NaCl aqueous solution having a concentration of 5 mass % is used; and a test time is set to 96 hours. Table 21 representatively shows: sample No. 43 in which the amount of adhesion of C is 15 mass %; sample No. 114 in which the amount of adhesion of C is 0 mass % and the lubricant is substantially not adhered; and sample No. 117 in which the amount of adhesion of C is 40 mass % and the lubricant is adhered excessively. It should be noted that results of samples No. 1 to No. 77 were similar to that of sample No. 43.

TABLE 13

| | 0.35 sq (Strand Wire Having Seven Wire Members with ϕ of 0.25 mm or Compressed Strand Wire Having Seven Wire Members with ϕ of 0.32 mm) | | | | | | | | | | | | |
|---|---|---|---|---|---|---|---|---|---|---|---|---|---|
| | Voids | Voids | Voids | Voids | Crystallized Materials | | | | | | | | |
| Sample No. | Surface Layer Total Area A [$\mu m^2$] | Surface Layer Total Area B [$\mu m^2$] | Area Ratio Inner Portion/ Surface Layer A | Area Ratio Inner Portion/ Surface Layer B | Average Area A [$\mu m^2$] | Average Area B [$\mu m^2$] | Number A [Number of Pieces] | Number B [Number of Pieces] | Area Ratio A [%] | Area Ratio B [%] | Average Crystal Grain Size [μm] | Hydrogen Concentration [ml/100 g] | C Amount [Mass %] |
| 1 | 1.6 | 1.7 | 2.0 | 2.1 | 0.6 | 0.5 | 26 | 31 | 96 | 95 | 19 | 8.0 | 11 |
| 2 | 0.5 | 0.5 | 5.2 | 5.1 | 1.4 | 1.4 | 26 | 23 | 89 | 89 | 13 | 2.8 | 5 |
| 3 | 0.6 | 0.6 | 3.3 | 3.4 | 0.9 | 0.9 | 48 | 44 | 93 | 94 | 25 | 3.0 | 19 |
| 4 | 1.5 | 1.6 | 1.3 | 1.3 | 0.2 | 0.1 | 41 | 40 | 100 | 97 | 7 | 7.7 | 18 |
| 5 | 0.7 | 0.7 | 2.0 | 2.1 | 0.6 | 0.6 | 53 | 50 | 96 | 9 | 19 | 3.7 | 5 |
| 6 | 1.0 | 1.0 | 5.0 | 5.2 | 1.3 | 1.3 | 90 | 90 | 90 | 89 | 48 | 3.1 | 16 |
| 7 | 1.3 | 1.3 | 6.9 | 6.7 | 1.9 | 2.0 | 129 | 138 | 85 | 87 | 36 | 5.9 | 14 |
| 8 | 2.0 | 2.0 | 2.8 | 2.8 | 0.8 | 0.7 | 77 | 72 | 95 | 95 | 46 | 7.9 | 16 |
| 9 | 1.9 | 1.9 | 1.8 | 1.8 | 0.8 | 0.8 | 106 | 94 | 97 | 97 | 31 | 7.9 | 16 |
| 10 | 1.7 | 1.7 | 7.9 | 7.8 | 2.3 | 2.2 | 148 | 156 | 83 | 85 | 2 | 6.4 | 17 |
| 11 | 1.7 | 1.7 | 5.8 | 5.6 | 1.5 | 1.4 | 117 | 128 | 88 | 90 | 33 | 6.0 | 17 |
| 12 | 0.7 | 0.8 | 4.8 | 4.7 | 1.3 | 1.3 | 219 | 208 | 90 | 93 | 44 | 3.2 | 8 |
| 13 | 0.4 | 0.5 | 1.1 | 1.1 | 0.1 | 0.1 | 219 | 229 | 100 | 99 | 24 | 2.6 | 7 |
| 14 | 0.1 | 0.1 | 4.6 | 4.6 | 1.3 | 1.2 | 386 | 368 | 91 | 90 | 8 | 0.7 | 15 |
| 15 | 1.7 | 1.6 | 1.2 | 1.2 | 0.1 | 0.1 | 258 | 266 | 100 | 98 | 25 | 7.2 | 14 |
| 16 | 0.9 | 0.9 | 5.5 | 5.6 | 1.5 | 1.6 | 354 | 340 | 89 | 86 | 17 | 3.3 | 8 |
| 17 | 1.0 | 0.9 | 1.6 | 1.7 | 0.4 | 0.4 | 385 | 393 | 97 | 100 | 48 | 4.4 | 11 |
| 18 | 1.3 | 1.4 | 3.0 | 3.0 | 0.8 | 0.9 | 397 | 396 | 94 | 95 | 45 | 4.4 | 5 |

TABLE 14

| | 0.35 sq (Strand Wire Having Seven Wire Members with ϕ of 0.25 mm or Compressed Strand Wire Having Seven Wire Members with ϕ of 0.32 mm) | | | | | | | | | | | | |
|---|---|---|---|---|---|---|---|---|---|---|---|---|---|
| | Voids | Voids | Voids | Voids | Crystallized Materials | | | | | | | | |
| Sample No. | Surface Layer Total Area A [$\mu m^2$] | Surface Layer Total Area B [$\mu m^2$] | Area Ratio Inner Portion/ Surface Layer A | Area Ratio Inner Portion/ Surface Layer B | Average Area A [$\mu m^2$] | Average Area B [$\mu m^2$] | Number A [Number of Pieces | Number B [Number of Pieces] | Area Ratio A [%] | Area Ratio B [%] | Average Crystal Grain Size [μm] | Hydrogen Concentration [ml/100 g] | C Amount [Mass %] |
| 19 | 0.2 | 0.2 | 1.3 | 1.2 | 0.3 | 0.3 | 138 | 128 | 98 | 100 | 32 | 0.7 | 8 |
| 20 | 0.2 | 0.2 | 4.1 | 4.0 | 1.1 | 1.2 | 214 | 219 | 92 | 91 | 41 | 1.0 | 2 |
| 21 | 1.5 | 1.6 | 2.0 | 2.1 | 0.5 | 0.6 | 189 | 175 | 97 | 100 | 26 | 7.6 | 12 |
| 22 | 1.2 | 1.2 | 6.1 | 5.9 | 1.7 | 1.8 | 141 | 132 | 87 | 85 | 27 | 4.5 | 9 |
| 23 | 0.1 | 0.1 | 3.4 | 3.3 | 0.9 | 0.9 | 132 | 147 | 93 | 90 | 4 | 0.4 | 8 |
| 24 | 0.2 | 0.3 | 4.6 | 4.8 | 1.2 | 1.1 | 240 | 237 | 91 | 92 | 21 | 1.2 | 17 |
| 25 | 0.9 | 0.9 | 5.2 | 5.2 | 1.5 | 1.4 | 207 | 218 | 89 | 92 | 12 | 4.0 | 15 |
| 26 | 0.8 | 0.8 | 6.9 | 6.7 | 1.8 | 1.8 | 212 | 230 | 85 | 86 | 32 | 2.5 | 6 |
| 27 | 1.1 | 1.2 | 1.4 | 1.3 | 0.4 | 0.4 | 184 | 169 | 98 | 97 | 6 | 4.8 | 7 |
| 28 | 1.0 | 0.9 | 1.3 | 1.3 | 0.1 | 0.2 | 154 | 165 | 100 | 99 | 5 | 5.0 | 11 |
| 29 | 1.6 | 1.7 | 1.9 | 1.9 | 0.5 | 0.5 | 135 | 139 | 97 | 95 | 9 | 6.2 | 30 |
| 30 | 0.6 | 0.6 | 2.5 | 2.6 | 0.7 | 0.7 | 257 | 247 | 95 | 95 | 20 | 2.3 | 7 |
| 31 | 0.7 | 0.6 | 31.0 | 31.1 | 2.9 | 3.0 | 157 | 166 | 76 | 74 | 10 | 3.6 | 8 |
| 32 | 0.2 | 0.3 | 1.5 | 1.5 | 0.2 | 0.2 | 157 | 144 | 100 | 98 | 41 | 0.4 | 8 |
| 33 | 1.7 | 1.7 | 4.6 | 4.5 | 1.2 | 1.2 | 167 | 165 | 91 | 94 | 44 | 7.1 | 18 |

TABLE 14-continued

| | 0.35 sq (Strand Wire Having Seven Wire Members with ϕ of 0.25 mm or Compressed Strand Wire Having Seven Wire Members with ϕ of 0.32 mm) | | | | | | | | | | | | |
|---|---|---|---|---|---|---|---|---|---|---|---|---|---|
| | Voids | Voids | Voids | Voids | Crystallized Materials | | | | | | | | |
| Sample No. | Surface Layer Total Area A [μm²] | Surface Layer Total Area B [μm²] | Area Ratio Inner Portion/ Surface Layer A | Area Ratio Inner Portion/ Surface Layer B | Average Area A [μm²] | Average Area B [μm²] | Number A [Number of Pieces | Number B [Number of Pieces] | Area Ratio A [%] | Area Ratio B [%] | Average Crystal Grain Size [μm] | Hydrogen Concentration [ml/100 g] | C Amount [Mass %] |
| 34 | 0.5 | 0.4 | 6.5 | 6.5 | 1.8 | 1.8 | 167 | 155 | 86 | 88 | 25 | 1.7 | 17 |
| 35 | 0.3 | 0.2 | 2.5 | 2.4 | 0.7 | 0.6 | 171 | 168 | 95 | 98 | 13 | 0.5 | 16 |
| 36 | 0.9 | 0.9 | 3.5 | 3.4 | 1.0 | 0.9 | 139 | 143 | 93 | 91 | 26 | 3.3 | 8 |
| 37 | 0.4 | 0.4 | 2.6 | 2.6 | 0.7 | 0.8 | 103 | 103 | 95 | 97 | 35 | 1.9 | 14 |
| 38 | 0.3 | 0.2 | 4.1 | 3.9 | 1.1 | 1.1 | 209 | 205 | 92 | 95 | 2 | 0.6 | 12 |
| 39 | 1.1 | 1.1 | 4.6 | 4.5 | 1.2 | 1.1 | 135 | 146 | 91 | 89 | 32 | 4.7 | 17 |
| 40 | 0.9 | 0.9 | 5.5 | 5.3 | 1.5 | 1.6 | 218 | 207 | 89 | 88 | 33 | 4.9 | 16 |
| 41 | 0.3 | 0.4 | 2.2 | 2.2 | 0.6 | 0.6 | 115 | 100 | 96 | 98 | 21 | 1.1 | 1 |
| 42 | 0.9 | 0.8 | 4.8 | 4.8 | 1.2 | 1.2 | 147 | 154 | 90 | 93 | 5 | 4.1 | 17 |
| 43 | 0.6 | 0.6 | 1.1 | 1.1 | 0.3 | 0.3 | 169 | 177 | 99 | 97 | 11 | 1.8 | 15 |
| 44 | 0.9 | 1.0 | 3.1 | 3.0 | 0.8 | 0.8 | 116 | 109 | 94 | 96 | 31 | 3.7 | 13 |
| 45 | 1.0 | 1.1 | 6.9 | 7.1 | 1.8 | 1.8 | 181 | 168 | 85 | 82 | 7 | 3.9 | 16 |
| 46 | 1.3 | 1.4 | 6.1 | 6.2 | 1.7 | 1.8 | 160 | 160 | 87 | 87 | 43 | 7.0 | 13 |
| 47 | 0.6 | 0.6 | 1.1 | 1.1 | 0.3 | 0.4 | 202 | 205 | 99 | 96 | 9 | 1.8 | 15 |

TABLE 15

| | 0.35 sq (Strand Wire Having Seven Wire Members with ϕ of 0.25 mm or Compressed Strand Wire Having Seven Wire Members with ϕ of 0.32 mm) | | | | | | | | | | | | |
|---|---|---|---|---|---|---|---|---|---|---|---|---|---|
| | Voids | Voids | Voids | Voids | Crystallized Materials | | | | | | | | |
| Sample No. | Surface Layer Total Area A [μm²] | Surface Layer Total Area B [μm²] | Area Ratio Inner Portion/ Surface Layer A | Area Ratio Inner Portion/ Surface Layer B | Average Area A [μm²] | Average Area B [μm²] | Number A [Number of Pieces] | Number B [Number of Pieces] | Area Ratio A [%] | Area Ratio B [%] | Average Crystal Grain Size [μm] | Hydrogen Concentration [ml/100 g] | C Amount [Mass %] |
| 48 | 1.1 | 1.0 | 5.5 | 5.5 | 1.6 | 1.6 | 131 | 124 | 89 | 86 | 32 | 3.6 | 7 |
| 49 | 0.4 | 0.4 | 4.6 | 4.5 | 1.2 | 1.2 | 123 | 119 | 91 | 92 | 5 | 2.1 | 7 |
| 50 | 1.4 | 1.4 | 2.2 | 2.3 | 0.6 | 0.6 | 164 | 178 | 96 | 95 | 41 | 5.2 | 6 |
| 51 | 0.4 | 0.4 | 4.8 | 4.9 | 1.3 | 1.3 | 125 | 119 | 90 | 90 | 22 | 2.4 | 15 |
| 52 | 1.2 | 1.2 | 5.5 | 5.6 | 1.6 | 1.6 | 184 | 197 | 89 | 91 | 6 | 6.9 | 17 |
| 53 | 0.7 | 0.6 | 4.8 | 4.8 | 1.3 | 1.3 | 176 | 184 | 90 | 90 | 44 | 2.8 | 6 |
| 54 | 0.1 | 0.1 | 4.6 | 4.5 | 1.3 | 1.3 | 151 | 165 | 91 | 90 | 27 | 0.5 | 3 |
| 55 | 1.1 | 1.1 | 5.0 | 4.9 | 1.4 | 1.4 | 137 | 129 | 90 | 88 | 46 | 6.4 | 3 |
| 56 | 0.3 | 0.4 | 2.7 | 2.7 | 0.7 | 0.7 | 137 | 135 | 95 | 98 | 27 | 1.3 | 18 |
| 57 | 0.6 | 0.6 | 3.1 | 3.1 | 0.9 | 0.9 | 135 | 149 | 94 | 95 | 21 | 1.7 | 16 |
| 58 | 0.9 | 0.8 | 3.8 | 3.8 | 1.1 | 1.1 | 225 | 229 | 92 | 95 | 2 | 3.0 | 14 |
| 59 | 1.4 | 1.4 | 1.1 | 1.1 | 0.3 | 0.3 | 191 | 179 | 98 | 99 | 46 | 7.5 | 11 |
| 60 | 1.2 | 1.2 | 2.6 | 2.6 | 0.7 | 0.6 | 144 | 137 | 98 | 93 | 15 | 5.3 | 9 |
| 61 | 0.8 | 0.8 | 2.5 | 2.5 | 0.7 | 0.6 | 222 | 231 | 95 | 96 | 13 | 3.6 | 17 |
| 62 | 0.8 | 0.9 | 1.3 | 1.3 | 0.3 | 0.4 | 186 | 197 | 98 | 97 | 5 | 4.7 | 13 |
| 63 | 1.2 | 1.2 | 5.8 | 5.6 | 1.7 | 1.7 | 210 | 207 | 88 | 85 | 39 | 4.7 | 12 |
| 64 | 1.4 | 1.4 | 6.9 | 7.0 | 1.8 | 1.7 | 201 | 202 | 85 | 85 | 20 | 5.1 | 5 |
| 65 | 1.0 | 1.0 | 5.8 | 6.1 | 1.6 | 1.6 | 125 | 123 | 88 | 87 | 5 | 5.2 | 7 |
| 66 | 0.8 | 0.9 | 4.1 | 4.1 | 1.1 | 1.2 | 206 | 211 | 92 | 91 | 6 | 4.3 | 5 |
| 67 | 0.5 | 0.5 | 5.2 | 5.3 | 1.5 | 1.5 | 241 | 256 | 89 | 88 | 12 | 2.0 | 9 |
| 68 | 0.6 | 0.6 | 3.1 | 2.9 | 0.9 | 0.8 | 142 | 138 | 94 | 94 | 14 | 1.8 | 8 |
| 69 | 0.4 | 0.5 | 1.2 | 1.2 | 0.1 | 0.1 | 281 | 278 | 100 | 99 | 32 | 1.5 | 19 |
| 70 | 0.9 | 0.9 | 1.1 | 1.2 | 0.3 | 0.3 | 343 | 359 | 98 | 97 | 44 | 4.8 | 8 |
| 71 | 1.9 | 1.9 | 5.2 | 5.4 | 0.5 | 0.4 | 168 | 179 | 90 | 90 | 7 | 7.9 | 30 |
| 72 | 0.7 | 0.7 | 1.1 | 1.1 | 0.3 | 0.2 | 165 | 152 | 99 | 100 | 10 | 1.7 | 14 |
| 73 | 0.6 | 0.5 | 1.1 | 1.2 | 0.3 | 0.4 | 179 | 172 | 99 | 97 | 12 | 2.0 | 18 |
| 74 | 0.6 | 0.5 | 1.1 | 1.1 | 0.2 | 0.3 | 150 | 148 | 99 | 98 | 11 | 1.8 | 13 |
| 75 | 0.3 | 0.2 | 1.1 | 1.1 | 0.3 | 0.2 | 144 | 149 | 99 | 99 | 12 | 0.7 | 17 |
| 76 | 0.5 | 0.5 | 1.1 | 1.1 | 0.3 | 0.3 | 187 | 193 | 99 | 98 | 11 | 1.4 | 15 |
| 77 | 0.6 | 0.5 | 1.5 | 1.5 | 0.4 | 0.3 | 169 | 180 | 98 | 96 | 10 | 1.9 | 18 |

TABLE 16

| | 0.35 sq (Strand Wire Having Seven Wire Members with ϕ of 0.25 mm or Compressed Strand Wire Having Seven Wire Members with ϕ of 0.32 mm) | | | | | | | | | | | | |
|---|---|---|---|---|---|---|---|---|---|---|---|---|---|
| | Voids | Voids | Voids | Voids | Crystallized Materials | | | | | | | | |
| Sample No. | Surface Layer Total Area A [μm²] | Surface Layer Total Area B [μm²] | Area Ratio Inner Portion/ Surface Layer A | Area Ratio Inner Portion/ Surface Layer B | Average Area A [μm²] | Average Area B [μm²] | Number A [Number of Pieces] | Number B [Number of Pieces] | Area Ratio A [%] | Area Ratio B [%] | Average Crystal Grain Size [μm] | Hydrogen Concentration [ml/100 g] | C Amount [Mass %] |
| 101 | 0.6 | 0.6 | 6.1 | 6.0 | 1.7 | 1.8 | 304 | 292 | 87 | 88 | 46 | 3.3 | 10 |
| 102 | 1.0 | 1.1 | 5.5 | 5.5 | 1.6 | 1.5 | 240 | 245 | 89 | 88 | 36 | 3.4 | 16 |
| 103 | 1.3 | 1.3 | 4.6 | 4.4 | 1.2 | 1.2 | 565 | 538 | 91 | 90 | 5 | 7.0 | 7 |
| 104 | 0.8 | 0.8 | 2.2 | 2.3 | 0.6 | 0.6 | 315 | 308 | 96 | 96 | 42 | 2.7 | 15 |
| 105 | 0.9 | 0.9 | 4.8 | 4.7 | 1.3 | 1.3 | 209 | 221 | 90 | 87 | 24 | 5.0 | 6 |
| 106 | 0.5 | 0.5 | 5.5 | 5.6 | 1.6 | 1.6 | 344 | 357 | 89 | 84 | 6 | 2.7 | 13 |
| 111 | 2.7 | 2.6 | 5.5 | 5.3 | 0.6 | 0.5 | 150 | 148 | 89 | 84 | 42 | 9.4 | 18 |
| 112 | 1.1 | 1.1 | 45.0 | 45.0 | 3.7 | 3.7 | 110 | 115 | 51 | 52 | 8 | 6.0 | 8 |
| 113 | 1.4 | 1.5 | 6.5 | 6.3 | 1.1 | 1.1 | 181 | 174 | 86 | 90 | 55 | 7.1 | 13 |
| 114 | 1.1 | 1.0 | 6.1 | 5.9 | 1.5 | 1.6 | 217 | 226 | 87 | 85 | 11 | 4.9 | 0 |
| 115 | 0.4 | 0.5 | 6.1 | 6.2 | 0.9 | 0.9 | 124 | 138 | 87 | 91 | 19 | 1.1 | 10 |
| 116 | 0.7 | 0.7 | 5.2 | 5.2 | 0.1 | 0.1 | 129 | 128 | 89 | 87 | 35 | 2.6 | 20 |
| 117 | 0.7 | 0.7 | 5.2 | 5.1 | 0.3 | 0.3 | 175 | 181 | 89 | 89 | 45 | 3.6 | 40 |
| 118 | 2.9 | 2.9 | 5.5 | 5.7 | 0.3 | 0.3 | 202 | 209 | 89 | 90 | 9 | 10.4 | 15 |
| 119 | 2.1 | 2.1 | 1.7 | 1.7 | 0.1 | 0.1 | 149 | 142 | 90 | 89 | 8 | 8.1 | 25 |

TABLE 17

| | 0.35 sq (Strand Wire Having Seven Wire Members with ϕ of 0.25 mm or Compressed Strand Wire Having Seven Wire Members with ϕ of 0.32 mm) | | | | | | |
|---|---|---|---|---|---|---|---|
| Sample No. | Surface Roughness [μm] | Dynamic Friction Coefficient (Elemental Wire) | Oxide Film Thickness [nm] | Impact Resistance [J/m] | Impact Resistance Unit Area [J/m · mm²] | Terminal Fixing Force [N] | Terminal Fixing Force Unit Area [N/mm²] |
| 1 | 1.36 | 0.1 | 57 | 8 | 23 | 40 | 114 |
| 2 | 0.90 | 0.2 | 15 | 8 | 22 | 43 | 124 |
| 3 | 1.22 | 0.1 | 34 | 8 | 23 | 56 | 161 |
| 4 | 0.22 | 0.1 | 12 | 9 | 25 | 64 | 184 |
| 5 | 2.82 | 0.4 | 55 | 9 | 26 | 62 | 178 |
| 6 | 0.26 | 0.1 | 10 | 8 | 24 | 70 | 199 |
| 7 | 2.88 | 0.2 | 28 | 8 | 22 | 74 | 211 |
| 8 | 0.84 | 0.1 | 45 | 6 | 18 | 76 | 216 |
| 9 | 0.84 | 0.1 | 45 | 5 | 13 | 86 | 245 |
| 10 | 2.18 | 0.1 | 40 | 6 | 16 | 72 | 206 |
| 11 | 1.40 | 0.1 | 6 | 5 | 15 | 78 | 224 |
| 12 | 2.13 | 0.2 | 2 | 7 | 21 | 72 | 205 |
| 13 | 2.37 | 0.3 | 48 | 5 | 14 | 86 | 247 |
| 14 | 0.68 | 0.1 | 18 | 5 | 14 | 88 | 251 |
| 15 | 2.73 | 0.2 | 6 | 7 | 21 | 94 | 270 |
| 16 | 0.98 | 0.1 | 8 | 4 | 12 | 92 | 262 |
| 17 | 2.67 | 0.2 | 118 | 4 | 10 | 103 | 296 |
| 18 | 2.00 | 0.3 | 48 | 4 | 12 | 100 | 286 |

TABLE 18

| | 0.35 sq (Strand Wire Having Seven Wire Members with ϕ of 0.25 mm or Compressed Strand Wire Having Seven Wire Members with ϕ of 0.32 mm) | | | | | | |
|---|---|---|---|---|---|---|---|
| Sample No. | Surface Roughness [μm] | Dynamic Friction Coefficient (Elemental Wire) | Oxide Film Thickness [nm] | Impact Resistance [J/m] | Impact Resistance Unit Area [J/m · mm²] | Terminal Fixing Force [N] | Terminal Fixing Force Unit Area [N/mm²] |
| 19 | 1.80 | 0.2 | 34 | 9 | 25 | 70 | 199 |
| 20 | 1.56 | 0.5 | 2 | 9 | 27 | 72 | 205 |

TABLE 18-continued

| Sample No. | 0.35 sq (Strand Wire Having Seven Wire Members with ϕ of 0.25 mm or Compressed Strand Wire Having Seven Wire Members with ϕ of 0.32 mm) | | | | | | |
|---|---|---|---|---|---|---|---|
| | Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
| 21 | 2.13 | 0.2 | 23 | 9 | 24 | 72 | 205 |
| 22 | 2.91 | 0.3 | 20 | 8 | 22 | 71 | 204 |
| 23 | 1.52 | 0.2 | 46 | 7 | 21 | 70 | 201 |
| 24 | 1.55 | 0.1 | 18 | 4 | 10 | 82 | 233 |
| 25 | 2.34 | 0.2 | 27 | 9 | 25 | 73 | 208 |
| 26 | 0.55 | 0.1 | 45 | 4 | 11 | 93 | 266 |
| 27 | 0.06 | 0.1 | 31 | 10 | 28 | 72 | 205 |
| 28 | 1.55 | 0.1 | 27 | 11 | 33 | 31 | 230 |
| 29 | 0.72 | 0.1 | 61 | 8 | 23 | 72 | 205 |
| 30 | 1.56 | 0.2 | 1 | 4 | 11 | 75 | 213 |
| 31 | 2.15 | 0.2 | 13 | 9 | 25 | 71 | 202 |
| 32 | 0.14 | 0.1 | 48 | 8 | 22 | 79 | 227 |
| 33 | 1.39 | 0.1 | 14 | 9 | 25 | 69 | 196 |
| 34 | 0.76 | 0.1 | 4 | 6 | 17 | 70 | 201 |
| 35 | 1.10 | 0.1 | 27 | 8 | 24 | 74 | 213 |
| 36 | 0.41 | 0.1 | 7 | 6 | 18 | 84 | 240 |
| 37 | 2.64 | 0.2 | 38 | 9 | 25 | 69 | 197 |
| 38 | 0.06 | 0.1 | 22 | 8 | 23 | 78 | 223 |
| 39 | 2.29 | 0.1 | 4 | 8 | 23 | 76 | 216 |
| 40 | 2.50 | 0.2 | 41 | 9 | 26 | 76 | 219 |
| 41 | 0.30 | 0.2 | 37 | 10 | 28 | 93 | 267 |
| 42 | 1.49 | 0.1 | 26 | 9 | 26 | 75 | 214 |
| 43 | 2.78 | 0.2 | 1 | 6 | 17 | 76 | 218 |
| 44 | 2.35 | 0.2 | 68 | 10 | 29 | 92 | 262 |
| 45 | 1.07 | 0.1 | 49 | 8 | 24 | 73 | 209 |
| 46 | 1.77 | 0.1 | 9 | 9 | 26 | 71 | 203 |
| 47 | 2.78 | 0.2 | 1 | 7 | 21 | 76 | 218 |

TABLE 19

| Sample No. | 0.35 sq (Strand Wire Having Seven Wire Members with ϕ of 0.25 mm or Compressed Strand Wire Having Seven Wire Members with ϕ of 0.32 mm) | | | | | | |
|---|---|---|---|---|---|---|---|
| | Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
| 48 | 0.03 | 0.1 | 4 | 8 | 21 | 97 | 278 |
| 49 | 1.16 | 0.2 | 41 | 9 | 26 | 74 | 211 |
| 50 | 2.49 | 0.3 | 32 | 7 | 20 | 74 | 213 |
| 51 | 1.56 | 0.1 | 62 | 9 | 27 | 74 | 212 |
| 52 | 2.51 | 0.2 | 6 | 9 | 26 | 74 | 211 |
| 53 | 1.63 | 0.2 | 5 | 9 | 27 | 73 | 210 |
| 54 | 2.26 | 0.8 | 44 | 9 | 27 | 92 | 264 |
| 55 | 0.72 | 0.2 | 43 | 4 | 12 | 93 | 265 |
| 56 | 2.15 | 0.1 | 8 | 6 | 18 | 105 | 301 |
| 57 | 0.93 | 0.1 | 8 | 10 | 28 | 90 | 258 |
| 58 | 1.43 | 0.1 | 43 | 10 | 29 | 90 | 257 |
| 59 | 0.13 | 0.1 | 28 | 8 | 21 | 84 | 240 |
| 60 | 1.43 | 0.2 | 44 | 8 | 22 | 75 | 213 |
| 61 | 0.31 | 0.1 | 13 | 8 | 22 | 73 | 208 |
| 62 | 1.81 | 0.1 | 26 | 10 | 28 | 91 | 261 |
| 63 | 0.17 | 0.1 | 18 | 12 | 33 | 93 | 266 |
| 64 | 2.52 | 0.4 | 19 | 8 | 24 | 97 | 278 |
| 65 | 0.19 | 0.1 | 35 | 7 | 19 | 95 | 271 |
| 66 | 2.12 | 0.3 | 25 | 4 | 11 | 111 | 316 |
| 67 | 2.46 | 0.2 | 27 | 8 | 23 | 97 | 278 |
| 68 | 1.50 | 0.2 | 1 | 7 | 21 | 76 | 217 |
| 69 | 2.35 | 0.1 | 10 | 6 | 17 | 108 | 308 |
| 70 | 1.74 | 0.2 | 25 | 5 | 14 | 107 | 305 |
| 71 | 1.05 | 0.1 | 25 | 10 | 29 | 75 | 214 |
| 72 | 2.64 | 0.2 | 2 | 6 | 18 | 75 | 215 |
| 73 | 2.21 | 0.1 | 1 | 7 | 19 | 76 | 216 |
| 74 | 2.97 | 0.2 | 3 | 5 | 15 | 73 | 207 |
| 75 | 2.12 | 0.1 | 1 | 7 | 21 | 77 | 221 |

TABLE 19-continued

| Sample No. | 0.35 sq (Strand Wire Having Seven Wire Members with ϕ of 0.25 mm or Compressed Strand Wire Having Seven Wire Members with ϕ of 0.32 mm) Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
|---|---|---|---|---|---|---|---|
| 76 | 2.51 | 0.2 | 5 | 6 | 16 | 74 | 211 |
| 77 | 2.46 | 0.1 | 7 | 7 | 20 | 67 | 193 |

TABLE 20

| Sample No. | 0.35 sq (Strand Wire Having Seven Wire Members with ϕ of 0.25 mm or Compressed Strand Wire Having Seven Wire Members with ϕ of 0.32 mm) Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
|---|---|---|---|---|---|---|---|
| 101 | 0.86 | 0.1 | 39 | 2 | 5 | 87 | 248 |
| 102 | 2.65 | 0.2 | 16 | 2 | 5 | 68 | 196 |
| 103 | 2.90 | 0.4 | 8 | 2 | 6 | 112 | 319 |
| 104 | 0.75 | 0.1 | 17 | 2 | 5 | 91 | 261 |
| 105 | 0.20 | 0.1 | 38 | 2 | 7 | 94 | 270 |
| 106 | 0.24 | 0.1 | 25 | 2 | 5 | 79 | 227 |
| 111 | 1.29 | 0.1 | 22 | 7 | 20 | 70 | 201 |
| 112 | 2.39 | 0.3 | 16 | 6 | 17 | 70 | 200 |
| 113 | 1.12 | 0.1 | 37 | 12 | 33 | 35 | 100 |
| 114 | 0.65 | 1.0 | 27 | 9 | 27 | 72 | 205 |
| 115 | 3.87 | 1.2 | 47 | 9 | 26 | 72 | 205 |
| 116 | 1.74 | 0.1 | 315 | 9 | 26 | 72 | 206 |
| 117 | 2.20 | 0.1 | 21 | 9 | 27 | 72 | 205 |
| 118 | 2.78 | 0.2 | 1 | 5 | 15 | 69 | 197 |
| 119 | 1.12 | 0.1 | 35 | 8 | 23 | 73 | 209 |

TABLE 21

| Sample No. | C Amount [Mass %] | Occurrence of Corrosion after Salt Spray Test (5% NaCl × 96 H) |
|---|---|---|
| 43 | 15 | Not Occurred |
| 114 | 0 | Occurred |
| 117 | 40 | Not Occurred |

In each of the Al alloy wires of samples No. 1 to No. 77 (hereinafter, also collectively referred to as "aged sample group") each of which is composed of the Al—Mg—Si-based alloy having such a specific composition that includes Mg and Si in the specific ranges and appropriately includes specific element a in the specific range and each of which has been subjected to the aging treatment, the evaluation parameter value of the impact resistance is so high as to be more than or equal to 4 J/m as shown in Table 17 to Table 19, as compared with that of each of the Al alloy wires of samples No. 101 to No. 106 (hereinafter, also collectively referred to as "comparative sample group") not including the specific composition. Moreover, as shown in Table 9 to Table 11, in each of the Al alloy wires of the aged sample group, the breaking elongation is high and the number of times of bending is also high in level. In view of this, it can be understood that the Al alloy wire of the aged sample group has a good balance of excellent impact resistance and excellent fatigue characteristic as compared with the Al alloy wire of the comparative sample group. Moreover, in the aged sample group, the mechanical characteristic and the electrical characteristic are excellent, that is, the tensile strength is high, the electrical conductivity is also high, the breaking elongation is also high, and the 0.2 more % proof stress is also high herein. Quantitatively, in each of the Al alloy wires of the aged sample group, the tensile strength is more than or equal to 150 MPa, the 0.2% proof stress is more than or equal to 90 MPa, the breaking elongation is more than or equal to 5%, and the electrical conductivity is more than or equal to 40% IACS. Moreover, the ratio "Proof Stress/Tensile" of the tensile strength and the 0.2% proof stress is also so high as to be more than or equal to 0.5. Further, it can be understood that each of the Al alloy wires of the aged sample group is excellent in fixation characteristic (more than or equal to 40 N) to the terminal portion as shown in Table 17 to Table 19. One reason for this is presumably as follows: in each of the Al alloy wires of the aged sample group, the work hardening exponent is so large as to be more than or equal to 0.05 (Table 9 to Table 11), so that an excellent strength improving effect by the work hardening when the crimp terminal was crimped was obtained.

Particularly, as shown in Table 17 to Table 19, the Al alloy wire of the aged sample group has a small dynamic friction coefficient. Quantitatively, the dynamic friction coefficient is less than or equal to 0.8, and is less than or equal to 0.5 in many samples. Since the dynamic friction coefficient is thus small, the elemental wires of the strand wire are likely to slide on one another, whereby it is considered that disconnection is less likely to occur when repeated bending is applied. Then, for each of a solid wire (having a wire diameter of 0.3 mm) having the composition of sample No. 41 and a strand wire produced using Al alloy wires each having the composition of sample No. 41, the number of times of bending until occurrence of breakage was found using the above-described repeated bending tester. Test conditions are as follows: bending distortion is 0.9%; and load is 12.2 MPa. Elemental wires each having a wire diameter ϕ of 0.3 mm are prepared in the same manner as in a solid Al alloy wire having a wire diameter ϕ of 0.3 mm. Seven such elemental wires were stranded and then compressed, thereby obtaining a compressed strand wire having a cross-sectional area of 0.35 $mm^2$ (0.35 sq). Then, the compressed strand wire is subjected to an aging treatment (conditions of sample No. 41 in Table 6). As a result of the test, the number of times of bending until occurrence of breakage in the solid wire was 3894, whereas the number of times of bending until occurrence of breakage in the strand wire was 12053. The number of times of bending was increased greatly. In view of this, when an elemental wire having a small dynamic friction coefficient is used for a strand wire, a fatigue characteristic improving effect can be expected. Moreover, as shown in Table 17 to Table 19, the Al alloy wire of the aged sample group has a small surface roughness. Quantitatively, the surface roughness is less than or equal to 3 μm. In many samples, the surface roughness is less than or equal to 2.5 μm. In some samples, the surface roughness is less than or equal to 2 μm or less than or equal to 1 μm, which is smaller than that of sample No. 115 (Table 20). In a comparison between sample No. 20 (Table 18, Table 10) and sample No. 115 (Table 20, Table 12) having the same composition, the dynamic friction coefficient is smaller, the surface roughness is smaller, and the number of times of bending is larger, and the impact resistance tends to be more excellent in sample No. 20. In view of this, a small dynamic friction coefficient is considered to contribute to improvement in fatigue characteristic and improvement in impact resistance. Moreover, in order to reduce the dynamic friction coefficient, it can be said that it is effective to attain a small surface roughness.

As shown in Table 13 to Table 15, it can be said that when the lubricant is adhered to the surface of each of the Al alloy wires of the aged sample group, particularly, when the amount of adhesion of C is more than or equal to 1 mass % (see a comparison between sample No. 41 (Table 14 and Table 18) and sample 114 (Table 16 and Table 20), the dynamic friction coefficient is likely to be small as shown in Table 17 to Table 19. It can be said that since the amount of adhesion of C is large even when the surface roughness is comparatively large, the dynamic friction coefficient is likely to be small (for example, sample No. 22 (Table 14 and Table 18). Moreover, as shown in Table 21, it is understood that since the lubricant is adhered to the surface of the Al alloy wire, the corrosion resistance is excellent. When the amount of adhesion of the lubricant (amount of adhesion of C) is too large, a connection resistance to the terminal portion is increased. Hence, it is considered that the amount of adhesion of the lubricant is preferably small to some extent, particularly, less than or equal to 30 mass %.

Further, the following facts can be pointed out based on this test.

For the below-described matters regarding the voids and the crystallized materials, reference is made to an evaluation result in the case of using measurement region A in the shape of a rectangle, and an evaluation result in the case of using measurement region B in the shape of a sector.

(1) As shown in Table 13 to Table 15, in each of the Al alloy wires of the aged sample group, the total area of the voids in the surface layer is less than or equal to 2.0 $\mu m^2$, which is smaller than that of each of the Al alloy wires of samples No. 111, No. 118, and No. 119 shown in Table 16. With attention being paid to voids in this surface layer, a comparison is made between sample No. 20 and sample No. 111 having the same composition, between sample No. 47 and sample No. 118 having the same composition, and between sample No. 71 and sample No. 119 having the same composition. It is understood that in samples No. 20, No. 47 and No. 71 each including a smaller amount of voids, the impact resistance is more excellent (Table 18, Table 19), the number of times of bending is larger, and the fatigue characteristic is more excellent (Table 10, Table 11). One reason for this is presumably as follows: in each of the Al alloy wires of samples No. 111, No. 118, and No. 119 in each of which a large amount of voids is in the surface layer, breakage is likely to occur due to the voids serving as origins of cracking when an impact or repeated bending is applied. In view of this, it can be said that by reducing the voids in the surface layer of the Al alloy wire, the impact resistance and the fatigue characteristic can be improved. Moreover, as shown in Table 13 to Table 15, in each of the Al alloy wires of the aged sample group, the content of the hydrogen is smaller than that of each of the Al alloy wires of samples No. 111, No. 118, and No. 119 shown in Table 16. In view of this, it is considered that one factor for the voids is hydrogen. In each of samples No. 111, No. 118, and No. 119, the temperature of melt was high and it is considered that a large amount of dissolved gas was likely to be in the melt, with the result that it is considered that hydrogen originated from the dissolved gas is increased. In view of these, in order to reduce the voids in the surface layer, it can be said that it is effective to set the temperature of melt at a low temperature (here, less than 750° C.) in the casting process.

In addition, in view of a comparison between sample No. 10 (Table 13) and each of samples No. 22 to No. 24 and (Table 14), it is understood that hydrogen is likely to be reduced when Cu is contained.

(2) As shown in Table 13 to Table 15, in each of the Al alloy wires of the aged sample group, the amount of voids is small not only in the surface layer but also in the inner portion thereof. Quantitatively, the ratio "Inner Portion/Surface Layer" of the total area of the voids is less than or equal to 44, here, is less than or equal to 35. In many samples, the ratio "Inner Portion/Surface Layer" of the total area of the voids is less than or equal to 20 or 10, which is smaller than that of sample No. 112 (Table 16). In a comparison between sample No. 20 and sample No. 112 having the same composition, the number of times of bending is larger (Table 10, Table 12) and the parameter value of the impact resistance is also higher (Table 18, Table 20) in sample No. 20 in which the ratio "Inner Portion/Surface Layer" is small. One reason for this is presumably as follows: in the Al alloy wire of sample No. 112 in which there are a large amount of voids in the inner portion, when repeated bending or the like is applied, cracking is progressed from the surface layer to the inner portion via the voids, thus facilitating occurrence of breakage. In view of this, it can be said that by reducing the voids in the surface layer and inner portion of the Al alloy wire, the impact resistance and the fatigue characteristic can be improved. Moreover, in view of this test, it can be said that as the cooling rate is larger, the ratio "Inner Portion/Surface Layer" is likely to be smaller. Therefore, in order to reduce the voids in the inner portion thereof, it can be said that it is effective to set the temperature of melt at a low temperature and set the cooling rate in the temperature range up to 650° C. to be fast (here, more than 0.5° C./second or more than or equal to 1° C./second, preferably, less than 25° C./second or less than 20° C./second) to some extent in the casting process.

(3) As shown in Table 13 to Table 15, in each of the Al alloy wires of the aged sample group, there is a certain amount of fine crystallized materials in the surface layer. Quantitatively, the average area of the crystallized materials is less than or equal to 3 $\mu m^2$. In many samples, the average area of the crystallized materials is less than or equal to 2 $\mu m^2$ or is less than or equal to 1.5 $\mu m^2$. Moreover, the number of such fine crystallized materials is more than 10 and less than or equal to 400, here, less than or equal to 350. In many samples, the number of such fine crystallized materials is less than or equal to 300, and in some samples, the number of such fine crystallized materials is less than or equal to 200 or less than or equal to 100. In a comparison between sample No. 20 (Table 10, Table 18) and sample No. 112 (Table 12, Table 20) having the same composition, the number of times of bending is larger and the parameter value of the impact resistance is also higher in sample No. 20 in which there are a certain amount of fine crystallized materials in the surface layer. In view of this, it is considered that the crystallized materials in the surface layer are fine and are therefore less likely to be origins of cracking, thus resulting in excellent impact resistance and fatigue characteristic. It is considered that the certain amount of fine crystallized materials therein serves to suppress crystal growth and facilitate bending or the like, thus resulting in one factor of improvement in fatigue characteristic.

Moreover, in this test, as shown in "Area Ratio" of Table 13 to Table 15, many (here, more than or equal to 70%; more than or equal to 80% or more than or equal to 85% in many cases) of the crystallized materials in the surface layer had a size of less than or equal to 3 $\mu m^2$. Also, the crystallized materials were fine and had a uniform size. In view of these, it is considered that each of the crystallized materials was less likely to be an origin of cracking.

Further, in this test, since the crystallized materials not only in the surface layer but also in the inner portion are small (less than or equal to 40 $\mu m^2$) as described above, it is considered that each of the crystallized materials can be less likely to be an origin of cracking and cracking can be less likely to be progressed from the surface layer to the inner portion via the crystallized materials, thus resulting in excellent impact resistance and fatigue characteristic.

In view of this test, in order to obtain the certain amount of fine crystallized materials, it can be said that it is effective to set the cooling rate in the specific temperature range to be fast (here, more than 0.5° C./second or more than or equal to 1° C./second, preferably, less than 25° C./second or less than 20° C./second) to some extent.

(4) As shown in Table 13 to Table 15, each of the Al alloy wires of the aged sample group has a small crystal grain size. Quantitatively, the average crystal grain size is less than or equal to 50 μm. In many samples, the average crystal grain size is less than or equal to 35 μm or less than or equal to 30 μm, and in some samples, the average crystal grain size is less than or equal to 20 μm, which are smaller than that of sample No. 113 (Table 16). In a comparison between sample No. 20 (Table 10) and sample No. 113 (Table 12) having the same composition, the number of times of bending in sample No. 20 is about twice as large as that in sample No. 113. Therefore, it is considered that the small crystal grain size contributes to improvement in fatigue characteristic, particularly. In addition, for example, in view of this test, it can be said that the crystal grain size is likely to be small by setting the aging temperature to a low temperature or setting the holding time to a short time.

(5) As shown in Table 17 to Table 19, each of the Al alloy wires of the aged sample group has a surface oxide film but the surface oxide film is so thin (see a comparison with sample No. 116 in Table 20) as to be less than or equal to 120 nm. Hence, it is considered that with each of these Al alloy wires, increase in connection resistance to the terminal portion can be reduced and a low-resistance connection structure can be constructed. Moreover, it is considered that the surface oxide film having an appropriate thickness (here, more than or equal to 1 nm) contributes to improvement in corrosion resistance. In addition, in view of this test, it can be said that when employing conditions under which the heat treatment such as the aging treatment is performed in the atmospheric air or a boehmite layer may be formed, the surface oxide film is likely to be thick. Also, it can be said that when a low-oxygen atmosphere is employed, the surface oxide film is likely to be thin.

(6) As shown in Table 11, Table 15, and Table 19, also when a change is made from each of manufacturing methods A, B, and D to manufacturing method G (sample No. 72 to No. 77), it can be said that an Al alloy wire having a small dynamic friction coefficient, an excellent impact resistance and an excellent fatigue characteristic is obtained. Particularly, by adjusting the wire drawing condition, the heat treatment condition, or the like, an Al alloy wire having a small dynamic friction coefficient, an excellent impact resistance and an excellent fatigue characteristic can be manufactured, thus resulting in a high degree of freedom of manufacturing condition.

As described above, the Al alloy wire that is composed of the Al—Mg—Si-based alloy having the specific composition, that has been through the aging treatment, and that has a small dynamic friction coefficient has a high strength, a high toughness, a high conductivity, an excellent connection strength to the terminal portion, an excellent impact resistance, and an excellent fatigue characteristic. Such an Al alloy wire is expected to be utilizable suitably for a conductor of a covered electrical wire, particularly, a conductor of a terminal-equipped electrical wire to which a terminal portion is attached.

The present invention is defined by the terms of the claims, rather than these examples, and is intended to include any modifications within the scope and meaning equivalent to the terms of the claims.

For example, the composition of the alloy, the cross-sectional area of the wire member, the number of wires stranded together in the strand wire, and the manufacturing conditions (the temperature of melt, the cooling rate during the casting, the heat treatment time, the heat treatment condition, and the like) in Test Example 1 can be appropriately changed.

[Clauses]

As an aluminum alloy wire excellent in impact resistance and fatigue characteristic, a below-described configuration can be employed. As a method of manufacturing the aluminum alloy wire excellent in impact resistance and fatigue characteristic, a below-described method can be employed.

[Clause 1]

An aluminum alloy wire composed of an aluminum alloy, wherein the aluminum alloy contains more than or equal to 0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio, and the aluminum alloy wire has a dynamic friction coefficient of less than or equal to 0.8.

[Clause 2]

The aluminum alloy wire according to [clause 1], wherein the aluminum alloy wire has a surface roughness of less than or equal to 3 μm.

[Clause 3]

The aluminum alloy wire according to [clause 1] or [clause 2], wherein a lubricant is adhered to a surface of the aluminum alloy wire, and an amount of adhesion of C originated from the lubricant is more than 0 mass % and less than or equal to 30 mass %.

[Clause 4]

The aluminum alloy wire according to any one of [clause 1] to [clause 3], wherein in a transverse section of the aluminum alloy wire, a void measurement region in a shape of a sector having an area of 1500 $\mu m^2$ is defined within an annular surface layer region extending from a surface of the aluminum alloy wire by 30 μm in a depth direction, and a total cross-sectional area of the voids in the void measurement region in the shape of the sector is less than or equal to 2 $\mu m^2$.

[Clause 5]

The aluminum alloy wire according to [clause 4], wherein in the transverse section of the aluminum alloy wire, an inner void measurement region in a shape of a rectangle having a short side length of 30 μm and a long side length of 50 μm is defined such that a center of the rectangle of the inner void measurement region coincides with a center of the aluminum alloy wire, and a ratio of a total cross-sectional area of voids in the inner void measurement region to the total cross-sectional area of the voids in the void measurement region in the shape of the sector is more than or equal to 1.1 and less than or equal to 44.

[Clause 6]

The aluminum alloy wire according to [clause 4] or [clause 5], wherein a content of hydrogen in the aluminum alloy wire is less than or equal to 8.0 ml/100 g.

[Clause 7]

The aluminum alloy wire according to any one of [clause 1] to [clause 6], wherein in a transverse section of the aluminum alloy wire, a crystallization measurement region in a shape of a sector having an area of 3750 $\mu m^2$ is defined within an annular surface layer region extending from a surface of the aluminum alloy wire by 50 μm in a depth direction, and an average area of crystallized materials in the crystallization measurement region in the shape of the sector is more than or equal to 0.05 $\mu m^2$ and less than or equal to 3 $\mu m^2$.

[Clause 8]

The aluminum alloy wire according to [clause 7], wherein the number of the crystallized materials in the crystallization measurement region in the shape of the sector is more than 10 and less than or equal to 400.

[Clause 9]

The aluminum alloy wire according to [clause 7] or [clause 8], wherein in the transverse section of the aluminum alloy wire, an inner crystallization measurement region in a shape of a rectangle having a short side length of 50 μm and a long side length of 75 μm is defined such that a center of the rectangle of the inner crystallization measurement region coincides with a center of the aluminum alloy wire, and an average area of crystallized materials in the inner crystallization measurement region is more than or equal to 0.05 $\mu m^2$ and less than or equal to 40 $\mu m^2$.

[Clause 10]

The aluminum alloy wire according to any one of [clause 1] to [clause 9], wherein an average crystal grain size of the aluminum alloy is less than or equal to 50 μm.

[Clause 11]

The aluminum alloy wire according to any one of [clause 1] to [clause 10], wherein a work hardening exponent of the aluminum alloy wire is more than or equal to 0.05.

[Clause 12]

The aluminum alloy wire according to any one of [clause 1] to [clause 11], wherein a thickness of a surface oxide film of the aluminum alloy wire is more than or equal to 1 nm and less than or equal to 120 nm.

[Clause 13]

The aluminum alloy wire according to any one of [clause 1] to [clause 12], wherein the aluminum alloy further contains one or more elements selected from Fe, Cu, Mn, Ni, Zr, Cr, Zn, and Ga, wherein more than or equal to 0 mass % and less than or equal to 0.5 mass % of each of the one or more elements is contained, and more than or equal to 0 mass % and less than or equal to 1.0 mass % of the one or more elements is contained in total.

[Clause 14]

The aluminum alloy wire according to any one of [clause 1] to [clause 13], wherein the aluminum alloy further contains at least one of more than or equal to 0 mass % and less than or equal to 0.05 mass % of Ti and more than or equal to 0 mass % and less than or equal to 0.005 mass % of B.

[Clause 15]

The aluminum alloy wire according to any one of [clause 1] to [clause 14], wherein one or more of the following conditions are satisfied: a tensile strength is more than or equal to 150 MPa; a 0.2% proof stress is more than or equal to 90 MPa; a breaking elongation is more than or equal to 5%; and an electrical conductivity is more than or equal to 40% IACS.

[Clause 16]

An aluminum alloy strand wire comprising a plurality of the aluminum alloy wires recited in any one of [clause 1] to [clause 15], the plurality of the aluminum alloy wires being stranded together.

[Clause 17]

The aluminum alloy strand wire according to [clause 16], wherein a strand pitch is more than or equal to 10 times and less than or equal to 40 times as large as a pitch diameter of the aluminum alloy strand wire.

[Clause 18]

A covered electrical wire comprising: a conductor; and an insulation cover that covers an outer circumference of the conductor, wherein the conductor includes the aluminum alloy strand wire recited in [clause 16] or [clause 17].

[Clause 19]

A terminal-equipped electrical wire comprising: the covered electrical wire recited in [clause 18]; and a terminal portion attached to an end portion of the covered electrical wire.

[Clause 20]

A method of manufacturing an aluminum alloy wire, the method comprising:

a casting step of forming a cast material by casting a melt of an aluminum alloy that contains more than or equal to 0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio;

an intermediate working step of performing plastic working to the cast material to form an intermediate work material;

a wire-drawing step of performing wire drawing to the intermediate work material to form a wire-drawn member; and a heat treatment step of performing a heat treatment during the wire drawing or after the wire-drawing step, wherein in the wire-drawing step, a wire drawing die having a surface roughness of less than or equal to 3 μm is used.

REFERENCE SIGNS LIST

1: covered electrical wire
10: terminal-equipped electrical wire
2: conductor
20: aluminum alloy strand wire
22: aluminum alloy wire (elemental wire)
220: surface layer region
222: surface-layer void measurement region
224: void measurement region
22S: short side
22L: long side
P: contact point
T: tangent line
C: straight line
g: void
3: insulation cover
4: terminal portion
40: wire barrel portion
42: fitting portion
44: insulation barrel portion
S: sample
100: mount
110: weight
150: counterpart material

The invention claimed is:

1. A method of manufacturing an aluminum alloy wire, the method comprising:

a casting step of forming a cast material by casting a melt of an aluminum alloy that contains more than or equal to 0.03 mass % and less than or equal to 1.5 mass % of Mg, more than or equal to 0.02 mass % and less than or equal to 2.0 mass % of Si, and a remainder of Al and an inevitable impurity, Mg/Si being more than or equal to 0.5 and less than or equal to 3.5 in mass ratio, wherein the aluminum alloy is molten at a temperature less than 750° C. and more than 675° C.;

an intermediate working step of performing plastic working to the cast material to form an intermediate work material;

a wire-drawing step of performing wire drawing to the intermediate work material to form a wire-drawn member; and a heat treatment step of performing a heat treatment during the wire drawing or after the wire-drawing step, wherein in the wire-drawing step, a wire drawing die having a surface roughness of less than or equal to 3 μm is used, wherein in the wire-drawing step, a lubricant is used and an amount of adhesion of C to a surface of the wire-drawn member is set to more than or equal to 0.5 mass % and less than or equal to 25 mass % of the aluminum alloy by adjusting an amount of application of the lubricant, and wherein a heat treatment condition in the heat treatment step is adjusted in order to achieve a desired value of a remaining amount of the lubricant on the surface of the wire-drawn member after the heat treatment step.

2. The method according to claim 1, wherein the heat treatment step is performed to achieve a breaking elongation of more than or equal to 5%.

* * * * *